US010816915B2

(12) United States Patent
Michibata

(10) Patent No.: US 10,816,915 B2
(45) Date of Patent: Oct. 27, 2020

(54) IMAGE FORMING DEVICE, AND CONTROL METHOD AND PROGRAM THEREOF

(71) Applicant: Konica Minolta, Inc., Chiyoda-ku, Tokyo (JP)

(72) Inventor: Takumi Michibata, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/353,247

(22) Filed: Mar. 14, 2019

(65) Prior Publication Data

US 2019/0286014 A1 Sep. 19, 2019

(30) Foreign Application Priority Data

Mar. 15, 2018 (JP) ..... 2018-047397

(51) Int. Cl.
*G03G 15/08* (2006.01)
*G03G 15/01* (2006.01)

(52) U.S. Cl.
CPC ..... *G03G 15/0891* (2013.01); *G03G 15/0121* (2013.01); *G03G 15/0879* (2013.01)

(58) Field of Classification Search
CPC ..... G03G 15/0891; G03G 15/0894; G03G 15/0121; G03G 15/0184; G03G 15/0865; G03G 15/0879
See application file for complete search history.

(56) References Cited

U.S. PATENT DOCUMENTS 8,320,799 B2 * 11/2012 Yoshida ..... G03G 15/0126 399/258
2003/0152394 A1 * 8/2003 Nakase ..... G03G 15/0896 399/27

FOREIGN PATENT DOCUMENTS

JP 2015001638 A 1/2015
WO 2010032634 A1 3/2010

* cited by examiner

*Primary Examiner* — Walter L Lindsay, Jr.
*Assistant Examiner* — Andrew V Do
(74) *Attorney, Agent, or Firm* — Cantor Colburn LLP

(57) ABSTRACT

An image forming device that forms an image through exposure of any one of a plurality of photosensitive members to light, image developing, and image transfer. The image forming device includes a holder, a conveyance unit, a first developer unit, and a second developer unit. The holder holds one or more containers of developer and causes the developer to flow out from a container selected from the held containers. The conveyance unit conveys the developer from the container to a destination and can switch the destination between at least the first developer unit and the second developer unit. The first developer unit uses the developer to develop an electrostatic latent image formed on a first photosensitive member. The second developer unit uses the developer to develop an electrostatic latent image formed on a second photosensitive member. The image is the same color regardless of which developer unit is used.

6 Claims, 9 Drawing Sheets

IMAGE FORMING DEVICE, AND CONTROL METHOD AND PROGRAM THEREOF

CROSS-REFERENCE TO RELATED APPLICATION

The present invention claims priority under 35 U.S.C. § 119 to Japanese Patent Application No. 2018-047397 filed Mar. 15, 2018, the contents of which are hereby incorporated herein by reference in their entirety.

BACKGROUND

Technical Field

The present disclosure relates to image forming devices, and in particular to developer replenishment.

Related Art

An electrophotographic image forming device such as a printer, copier, or facsimile machine forms an image on a sheet by the following processes (for example, see WO 2010/032634). Charging/exposure: a photosensitive member is charged and exposed, forming an electrostatic latent image thereon. Developing: the electrostatic latent image is developed by toner. Transfer: a toner image is transferred from the photosensitive member to a sheet. Fixing: the toner image is fixed by heat and pressure to the sheet.

Regarding electrophotographic image forming devices, there is still strong demand for high quality and high function models such as full-color devices and multi-function peripherals (MFPs). However, along with the spread of such models, in recent years demand is increasing for models made cheaper by having functional limitations, such as monochrome devices. As one idea aiming to meet both demands, JP 2015-001638 describes repurposing a structure of a tandem-type full-color device for use as a monochrome device. A tandem-type device has a structure in which, for example, four colors of toner image (yellow (Y), magenta (M), cyan (C), and black (K)) are formed in parallel, and four imaging units are arranged in one row. In each imaging unit, three functional sections that individually perform charging, development, and transfer, i.e., monochrome image forming processes other than exposure and fixing, are integrated. Regarding exposure, there are cases where an optical scanning unit common to a plurality of imaging units performs exposure, and there are cases where dedicated optical writing units each integrated with an image forming unit perform exposure. The technique described in JP 2015-001638 makes use of a structure in which elements for forming toner images in colors other than K, including imaging units, are removed from the tandem-type device for use as a K color monochrome device. This monochrome device has structure in common with the original full color device, and therefore it is possible to use the same parts and share a production line. Thus, the technique enables production of inexpensive monochrome devices while maintaining supply capability for producing full color devices.

In a tandem-type full color device structure repurposed as a monochrome device, in addition to three colors of imaging units other than K color, a mechanism for replenishing developer that includes said three colors is removed, that is, a holder of toner containers, and a conveyance unit such as hoppers for conveying developer from toner containers to imaging units are removed. Accordingly, with the design as is, a space inside the casing previously occupied by the removed mechanism of the original full color device design remains as dead space. As an effective use of this space, JP 2015-001638 proposes installation of a spare toner container and a conveyance mechanism to convey developer from the spare toner container. In this proposal, the holder of toner containers and the developer conveyance unit for the three colors other than K color of the original full color device can be repurposed as a monochrome device, and therefore the inexpensiveness of the monochrome device is not compromised.

SUMMARY

However, this proposal still leaves the dead space formerly occupied by the three removed imaging units. It is certainly not easy for a person skilled in the art to find an effective broad use of the dead space without excessively increasing manufacturing cost due to an increase in number of parts, complication of manufacturing processes, or the like.

An object of the present disclosure is to solve the technical problem described above, and in particular to provide an image forming device that can effectively utilize a wide range of space inside the casing without compromising on the inexpensiveness of the manufactured product.

To achieve at least one of the abovementioned objects, according to an aspect of the present disclosure, an image forming apparatus that forms an image through exposure of any one of a plurality of photosensitive members to light, image developing, and image transfer, reflecting one aspect of the present disclosure, comprises: a holder that holds one or more containers of developer and causes the developer to flow out from a container selected from the one or more containers; a conveyance unit that conveys the developer from the container to a destination and can switch between at least a first destination and a second destination; a first developer unit that uses the developer to develop an electrostatic latent image formed on a first photosensitive member among the plurality of photosensitive members; and a second developer unit that uses the developer to develop an electrostatic latent image formed on a second photosensitive member among the plurality of photosensitive members, wherein the first destination is the first developer unit and the second destination is the second developer unit, and the image is the same color regardless of which developer unit is used.

BRIEF DESCRIPTION OF DRAWINGS

The advantages and features provided by one or more embodiments of the disclosure will become more fully understood from the detailed description given hereinbelow and the appended drawings which are given by way of illustration only, and thus are not intended as a definition of the limits of the present disclosure.

DETAILED DESCRIPTION

Hereinafter, one or more embodiments of the present disclosure will be described with reference to the drawings. However, the scope of the disclosure is not limited to the disclosed embodiments.

The following describes at least one embodiment of the present disclosure with reference to the drawings.

[External Appearance of Image Forming Device]

Figure 1A:
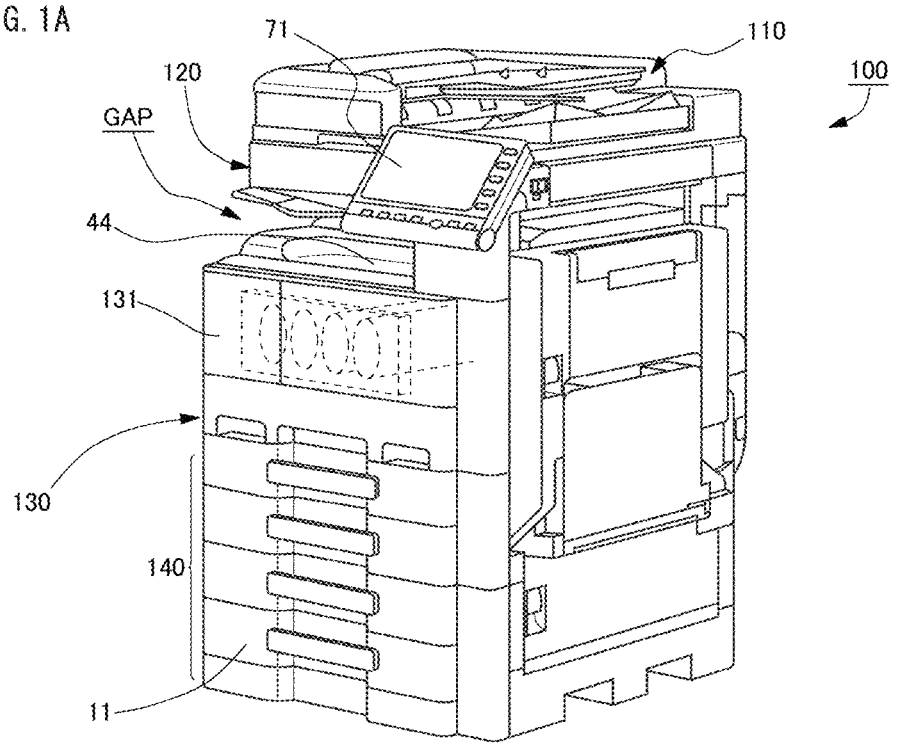
FIG. 1A is a perspective view diagram illustrating an external appearance of an image forming device according to at least one embodiment of the present disclosure.

FIG. 1A is a perspective view diagram illustrating an external appearance of an image forming device 100 according to at least one embodiment of the present disclosure. The image forming device 100 is a multi-function peripheral (MFP), and includes scanner, copier, and printer functions. An automatic document feeder (ADF) 110 is attached to an upper surface of a casing of the MFP 100 and may be opened and closed. A scanner 120 is built into an upper portion of the casing just under the ADF 110, and an operation panel 71 is attached to a front surface thereof. A gap GAP is provided under the scanner 120, and a printer 130 is built into a lower portion of the casing of the MFP 100 below the gap GAP. Paper cassettes 11 are attached to a bottom portion 140 of the printer 130 and can be pulled out and pushed in. The MFP 100 is an in-body paper ejection type. That is, a discharge tray 44 is installed in the gap GAP between the scanner 120 and the printer 130, the discharge tray 44 accommodating sheets discharged from a discharge outlet (not illustrated) at the back of the gap GAP.

[Internal Structure of Image Forming Device]

Figure 1B:
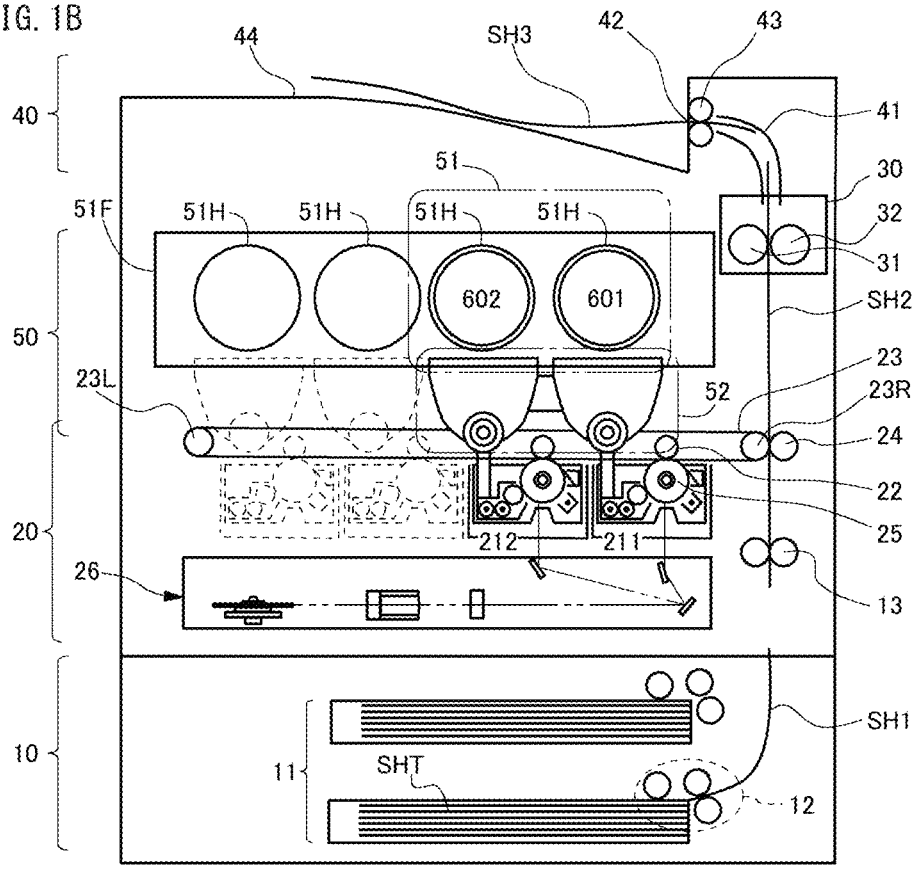
FIG. 1B is a frontal view diagram schematically illustrating an internal structure of a printer installed in the image forming device.

FIG. 1B is a frontal view diagram schematically illustrating an internal structure of the printer 130. In FIG. 1B, internal elements of the printer 130 are drawn as if seen through the front of the casing. The printer 130 is an electrophotographic monochrome device, and includes a feeder section 10, an imaging section 20, a fixing section 30, and a discharge section 40. These sections 10, 20, 30, 40 cooperate to form a toner image of a single color, for example K color, on a sheet, based on image data. The printer 130 further includes a replenishment section 50. The replenishment section 50 holds two toner bottles 601, 602 and replenishes K color toner in the developer section 20 from the bottles.

In particular, the printer 130 has a structure in which the structure of a tandem type full color device is repurposed as a monochrome device. More specifically, in a full color device, the imaging section 20 has a structure in which a total of four imaging units for the colors Y, M, C, K are disposed in parallel, and the replenishment section 50 has a structure in which a total of four toner bottles for the colors Y, M, C, K can be installed. In contrast, the imaging section 20 of the printer 130 does not include imaging units for the colors Y, M, C but includes two K color imaging units 211, 212 in positions corresponding to imaging units for the colors C, K, and the replenishment section 50 holds two K color toner bottles 601, 602 in positions corresponding to toner bottles for the colors C, K.

The feeder section 10 supplies sheets one by one from the paper cassettes 11 to the imaging section 20. More specifically, the feeder section 10 first uses a feed roller group 12 to separate a sheet SH1 from a stack SHT of sheets stored in the paper cassettes 11. The feeder section 10 next uses a timing roller 13 to output a separated sheet SH2 to the imaging section 20 according to a timing. Here, "sheet" can mean a paper or resin thin film or thin sheet-shaped material, article, or printed matter. Types of sheet or types of paper storable in the paper cassettes 11 include plain, high-quality, color-copier, and coated sheets, and sizes include standard sizes such as A3, A4, A5, B4, etc. Further, sheets can be stored in a portrait or landscape orientation.

The imaging section 20 is, for example, an intermediate transfer imaging device, which forms a K color toner image on a surface of an intermediate transfer belt 23 by using either of the two K color imaging units 211, 212, and transfers the toner image onto the sheet SH2 fed from the feeder section 10. The intermediate transfer belt 23 is wrapped around a driven pulley 23L and a drive pulley 23R. Between the pulleys 23L, 23R, the two imaging units 211, 212 and two primary transfer rollers 22 are arranged so that each imaging unit is paired with a primary transfer roller. A photosensitive drum 25 of the imaging unit 211 and one of the two primary transfer rollers 22 form a nip with the intermediate transfer belt 23 inbetween. Likewise, a photosensitive drum 25 of the imaging unit 212 and the other one of the two primary transfer rollers 22 form a nip with the intermediate transfer belt 23 inbetween. A secondary transfer roller 24 and the drive pulley 23R form a nip with the intermediate transfer belt 23 inbetween, and the sheet SH2 sent from the timing roller 13 passes through said nip. While the intermediate transfer belt 23 rotates (counterclockwise in FIG. 1B), either of the imaging units 211, 212 forms a K color toner image on a surface portion of the intermediate transfer belt 23 as it passes through the nip between the primary transfer roller 22 and the photosensitive drum 25. The sheet SH2 from the timing roller 13 is passed through the nip between the drive pulley 23R and the secondary transfer roller 24 at a timing synchronized with the toner image passing through the same nip. Thus, the toner image is transferred from the intermediate transfer belt 23 to the sheet SH2. The sheet SH2 is sent to the fixing section 30 by the drive pulley 23R and the secondary transfer roller 24.

The fixing section 30 heat fixes the toner image on the sheet SH2 sent from the imaging section 20. More specifically, the fixing section 30 passes the sheet SH2 through a nip between a fixing roller 31 and a pressure roller 32 while rotating said rollers. At this time, the fixing roller 31 applies heat from an internal heater to a surface of the sheet SH2 and the pressure roller 32 applies pressure to a heated portion of the sheet SH2 by pressing against the fixing roller 31. The toner image is fixed to the sheet SH2 by the heat from the fixing roller 31 and the pressure from the pressure roller 32. The fixing section 30 further sends the sheet SH2 to the discharge section 40 by rotation of the fixing roller 31 and the pressure roller 32.

The discharge section 40 discharges to the discharge tray 44 a sheet SH3 on which the toner image is fixed. More specifically, the discharge section 40 rotates a discharge roller 43 disposed inside of a discharge port 42 so that the sheet SH3, which has been moved from an upper portion of the fixing section 30 to the discharge port 42 following a guide plate 41, is sent out of the discharge port 42 by the circumferential surface of the discharge roller 43. Thus, the sheet SH3 is stored on the discharge tray 44.

The replenishment section 50 is disposed above the imaging section 20 and includes a holder 51 and a conveyance unit 52. The holder 51 detachably holds the toner bottles 601, 602 above the imaging units 211, 212, and causes developer in the toner bottles 601, 602 to flow out therefrom. When a door 131 at the front of the MFP 100 is opened, a front surface of the holder 51 is exposed to the outside, and therefore a user can install and remove the toner bottles 601, 602. The conveyance unit 52 is disposed directly below the holder 51 and is a mechanism that conveys developer that has flowed out from the toner bottles 601, 602 to the imaging units 211, 212. In particular, the conveyance unit 52 is able to switch a destination of developer between the imaging units 211, 212.

[Structure of Replenishment Section]

—Toner Bottles and Holder—

Figure 2:
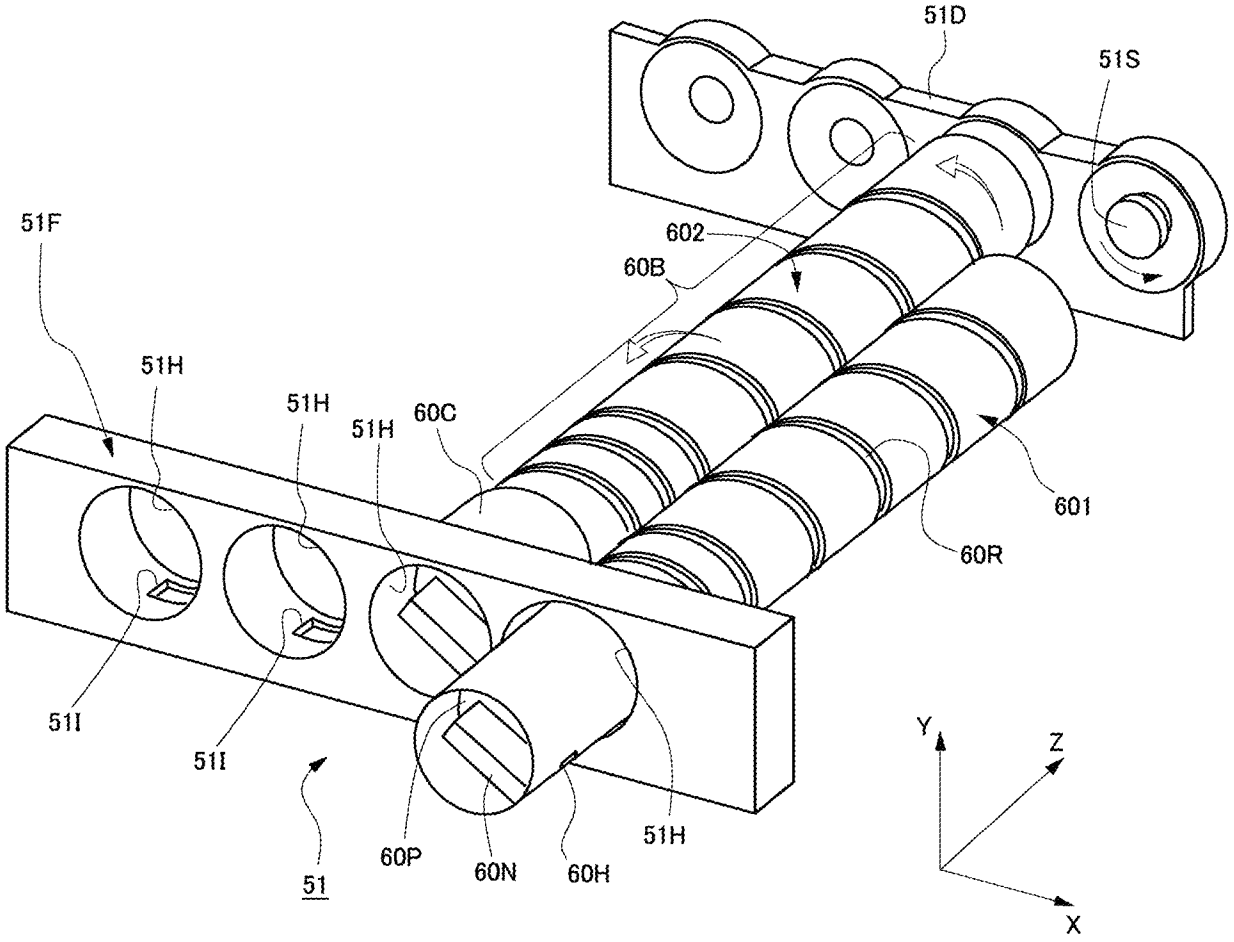
FIG. 2 is a perspective view diagram of toner bottles and holders installed in the printer.

FIG. 2 is a perspective view diagram of the toner bottles 601, 602 and the holder 51. The holder 51 includes a frame 51F and a drive unit 51D.

The toner bottles 601, 602 are each a long thin cylindrical container containing two-component developer. The two-component developer is a granular material including K color toner and a carrier. Each of the toner bottles 601, 602 includes a body 60B and a cover 60C. The body 60B is a long thin cylindrical member that has a bottom in an axial direction thereof (Z axis direction in FIG. 2), and includes a developer storage space therein. A rib 60R protrudes in a spiral from an inner surface of the body 60B surrounding the developer storage space, the spiral sharing the same axis as the body 60B. The cover 60C is a cylindrical member that is shorter in the axial direction (Z axis direction) than the body 60B. The cover shares the same axis as the body 60B and covers an open end thereof. In this state, the cover 60C is rotatable about the axis of the body 60B. An end of the cover 60C farthest from the body 60B is closed by a partition plate 60P. The partition plate 60P is rotatable about the axis of the cover 60C (Z axis). A user can change a rotation angle of the partition plate 60P by twisting a knob 60N protruding from an outer surface of the partition plate 60P. A side surface of the cover 60C includes a developer outlet port 60H. The outlet port 60H may be opened and closed according to the rotation angle of the partition plate 60P, meaning that the interior space of the body 60B is connected to or disconnected from the outside.

The frame 51F is, for example, a long, thin, rectangular frame, installed such that a longitudinal direction of which is parallel to a lateral direction of the MFP 100 (X axis direction in FIG. 2), and a plate surface of which is parallel to a vertical direction of the MFP 100 (Y axis direction in FIG. 2). Four circular holes 51H are arranged in one row in the lateral direction (X axis direction) in the plate surface of the frame 51F. The holes 51H have a common structure, including a common diameter, and in particular each include a developer inlet 511 in a lower portion of an inner surface thereof. The rightmost two of the holes 51H are positioned above the imaging units 211, 212, and the toner bottles 601, 602 can be inserted in a depth direction of the MFP 100 (Z axis direction in FIG. 2) into said holes 51H. When the toner bottle 602 is inserted into one of said holes 51H, the side surface of the cover 60C of the toner bottle 602 is fitted and fixed to the inner surface of said hole 51H. At this time, a mechanical switch (not illustrated) provided to the inner surface of said hole 51H is switched on by contact with the cover 60C of the toner bottle 602. Switching on and off of said switch allows the replenishment section 50 to detect attachment and detachment of the toner bottle 602 to and from said hole 51H. Further, when the outlet port 60H of the toner bottle 602 is positioned at the inlet port 511 of said hole 51H, and a user twists the knob 60N to rotate the partition plate 60P, the outlet port 60H opens to communicate with the inlet port 511. The leftmost two of the holes 51H of the frame 51F are remnants of the structure of the full color device, and if this were a full color device would be located above Y and M color imaging units, and would accept loading of Y and M color toner bottles. The printer 130 does not make use of said holes 51H, which remain as dead space.

The drive unit 51D extends in the lateral direction of the MFP 100 (X axis direction) at a fixed distance from the plate surface of the frame 51F in the depth direction of the MPF 100 (Z axis direction). The drive unit 51D includes a shaft 51S for each of the rightmost two of the holes 51H of the frame 51F, each of the shafts 51S protruding from a position opposing a corresponding one of said holes 51H, towards the corresponding one of said holes 51H. The drive unit 51D includes a motor (not illustrated) and a torque transmission mechanism such as gears, a belt, and the like, which transmits torque from the motor individually to each of the shafts 51S, thereby causing the shafts 51S to rotate about their axes (refer to arrow in FIG. 2). When the toner bottles 601, 602 are inserted into the corresponding holes 51H of the frame 51F, bottom faces of the bottles 601, 602 are removably connected to the shafts 51S. When the shafts 51S are rotated by the torque from the motor and the toner bottle 602 is connected, the body 60B of the toner bottle 602 is rotated about its axis (refer to white arrows in FIG. 2). In the interior of the body 60B undergoing rotation, developer, which is granular, is pushed by the rib 60R to flow along the rib 60R, thereby moving towards the cover 60C. If the outlet port 60H is open, developer that has moved from the body 60B to the cover 60C flows out from the outlet port 60H and drops into the inlet port 51I of the frame 51F.

Like the frame 51F, the drive unit 51D is a component common to a full color device. In a full color device, the drive unit 51D would include one shaft 51S for each of the two leftmost holes 51H of the frame 51F, and a mechanism that transfers torque from the motor to said shafts 51S. In the printer 130 these elements are omitted, and only members that would support these elements remain.

—Conveyance Unit—

Figure 3A:
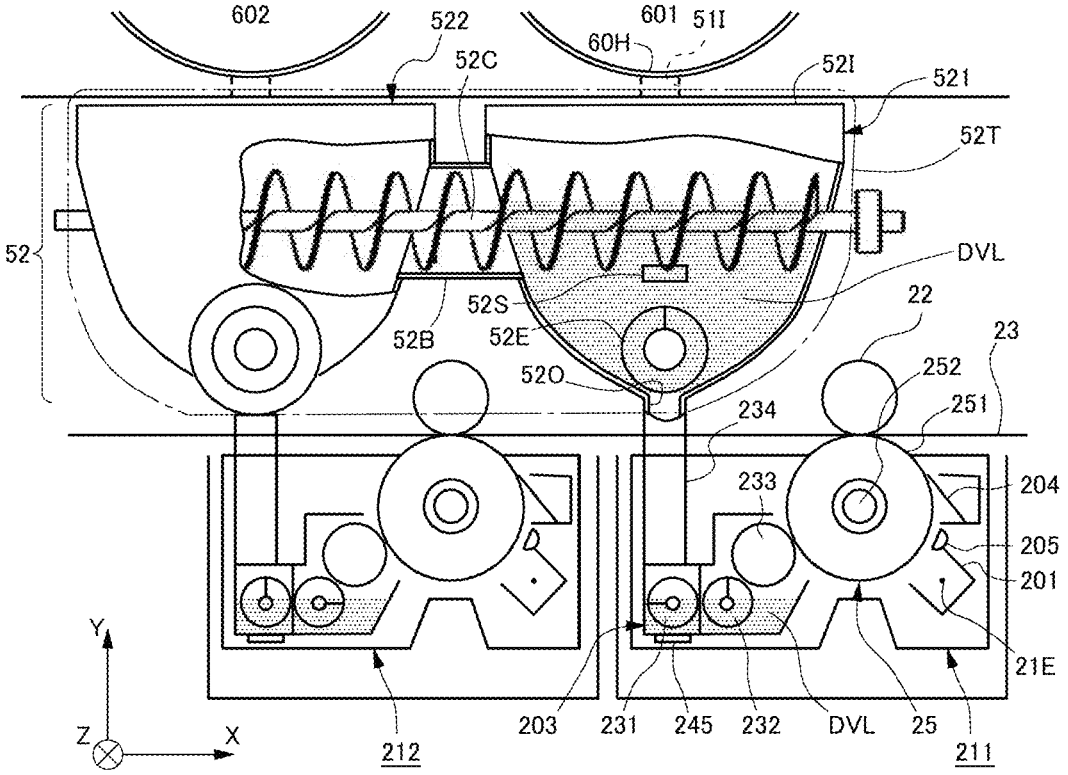
FIG. 3A is a frontal view diagram schematically illustrating internal structure of a conveyance unit and imaging units installed in the printer.
Figure 3B:
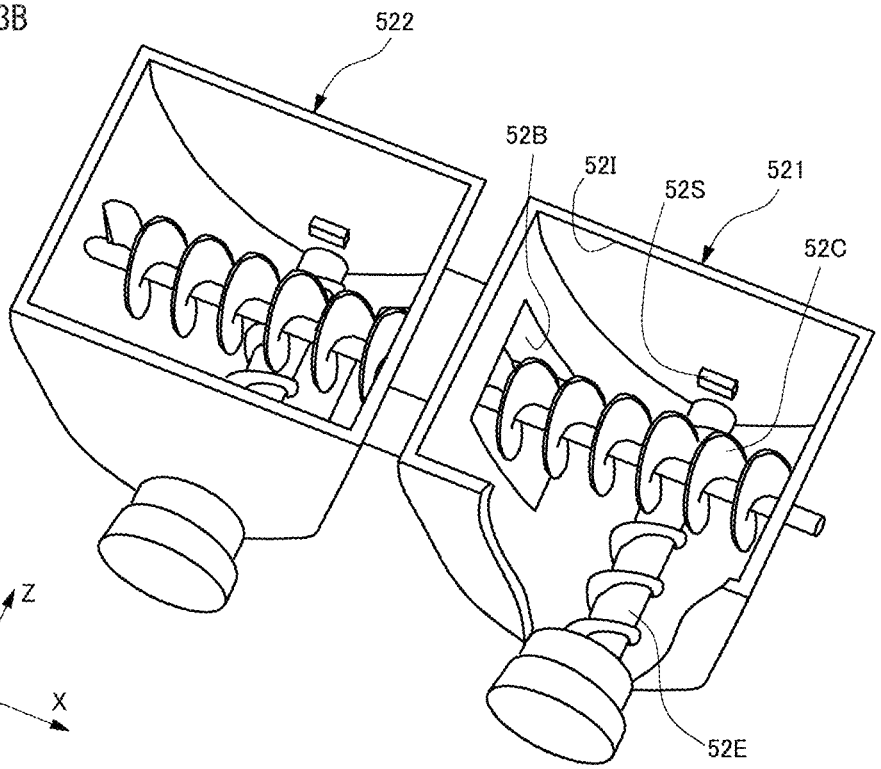
FIG. 3B is a perspective view diagram of the conveyance unit.

FIG. 3A is a frontal view diagram schematically illustrating internal structure of the conveyance unit 52 and the imaging units 211, 212, and FIG. 3B is a perspective view diagram of the conveyance unit 52. The conveyance unit 52 includes a storage 52T, ejection screws 52E, toner sensors 52S, and a transport screw 52C.

The storage 52T includes two hoppers 521, 522. The hoppers 521, 522 have the same shape and size and are connected to each other in the lateral direction (X axis direction). Each of the hoppers 521, 522 is a funnel-shaped container. For example, an inlet port 52I (top-side open end) thereof is rectangular, with side walls tapering inwards towards a bottom of the container (negative direction along the Y axis), and with an outlet port 520 at the bottom, the outlet port 520 being narrow and long in the depth direction of the MFP 100 (Z axis direction). The hoppers 521, 522, as illustrated in FIG. 1B, are disposed between the rightmost two of the holes 51H of the frame 51F and the imaging units 211, 212 therebelow. The inlet ports 51I of said holes 51H communicate with the inlet ports 52I of the hoppers 521, 522, and each of the imaging units 211, 212 has a replenishment pipe 234 that communicates with a corresponding one of the outlet ports 520 of the hoppers 521, 522. When the holder 51 causes developer DVL to be dropped from the outlet ports 60H of the toner bottles 601, 602 to the inlet ports 51I of the frame 51F, the developer DVL flows down into the hoppers 521, 522 from the inlet ports 51I via the inlet ports 52I.

The ejection screws 52E are auger screws and are disposed parallel to the depth direction (Z axis direction) at the bottom of the hoppers 521, 522, blocking the outlet ports 520 thereof. Both end portions along the axes of each of the ejection screws 52E pass through side walls of the hoppers 521, 522, and are supported (supports not illustrated) outside the hoppers 521, 522 so that the ejection screws 52E are rotatable about their own axes. The conveyance unit 52 further includes a motor and a torque transmission mechanism such as gears, a belt, and the like (not illustrated) that transmit torque from the motor to the ejection screws 52E to rotate the ejection screws 52E about their own axes. When the ejection screws 52E are stopped, the developer DVL is hindered from flowing into the outlet ports 520, and therefore temporarily accumulates in the hoppers 521, 522. In this state, when the ejection screws 52E rotate, the developer DVL accumulated in the hoppers 521, 522 is agitated by the ejection screws 52E, reducing friction, and therefore flows from the outlet ports 520 to the replenishing pipes 234 of the imaging units 211, 212.

The toner sensors 52S monitor amounts of developer stored in the hoppers 521, 522. The toner sensors 52S are, for example, transmissive photosensors, and as illustrated in FIG. 3B include light emitters and light receivers in projections from inner surfaces of the hoppers 521, 522. Each light emitter emits infrared rays or visible light, and each light receiver detects same. While an interface between developer and air in either of the hoppers 521, 522 is higher than the corresponding toner sensor 52S, light from the light emitter is blocked by the developer, and therefore the light receiver does not detect the light. When the interface between the developer and air becomes lower than the toner sensor 52S due to outflow from the outlet port 520, light from the light emitter is no longer blocked by the developer, and therefore the light receiver can detect the light. According to whether or not the light receiver detects the light from the light emitter, the toner sensor 52S switches a level of an output signal. The toner sensors 52S are installed at heights of the interfaces between the developer and air where stored amounts of the developer reach a permissible lower limit, and therefore whether or not amounts of developer in the hoppers 521, 522 are less than the permissible lower limit, i.e., whether or not the hoppers 521, 522 are empty (near empty) is expressed by the levels of the output signals.

Each set of the hoppers 521, 522, the ejection screws 52E, and the toner sensors 52S is a set of components in common with those of a full color device. In a full color device, a further two sets would be added and each set would be used for conveying developer of colors Y, M, C, K from toner bottles to corresponding imaging units. The printer 130 omits said two sets.

Side faces of the hoppers 521, 522 facing each other are connected to each other by a connecting path 52B that is rectangular in cross section. The connecting path 52B extends in the lateral direction (X axis direction) and is disposed higher than the ejection screws 52E. The transport screw 52C that passes through the connecting path 52B extends across an entire width of the hoppers 521, 522. The transport screw 52C is an auger screw. Both end portions along the axis of the transport screw 52C pass through side walls of the hoppers 521, 522, and are supported (support not illustrated) outside the hoppers 521, 522 so that the transport screw 52C is rotatable about its own axis. The conveyance unit 52 further includes a torque transmission mechanism such as gears, a belt, or the like for transmitting torque of the drive motor of the ejection screws 52E to the transport screw 52C, thereby rotating the transport screw 52C about its own axis (not illustrated). In particular, said torque transmission mechanism can rotate the transport screw 52C in either direction. For example, even if interfaces between the developer DVL and air are higher than the connecting path 52B in the first hopper 521 and lower than the connecting path 52B in the second hopper 522, if the transport screw 52C is stopped, passage of the developer DVL through the connecting path 52B is inhibited. If the transport screw 52C rotates, the developer DVL is transported by the transport screw 52C according to the direction of rotation, and moved via the connecting path 52B from the first hopper 521 to the second hopper 522. The transport screw 52C is rotatable in both directions, and therefore the developer DVL can be transported by the transport screw 52C between the hoppers 521, 522 as long as the interfaces between the developer DVL and air in the hoppers 521, 522 reach heights at which transport is possible.

The connecting path 52B and the transport screw 52C are elements specific to the printer 130 pertaining to an embodiment of the present disclosure, and are not included in structure of a full color device prior to repurposing. By transporting the developer DVL between the hoppers 521, 522 by using the connecting path 52B and the transport screw 52C, the conveyance unit 52 can switch a destination of the developer DVL from the toner bottles 601, 602 between the imaging units 211, 212. Details of said control are described later.

[Imaging Unit Structure]

FIG. 3A illustrates an enlarged frontal view of the imaging units 211, 212 illustrated in FIG. 1B. In addition to the photosensitive drum 25, each of the imaging units 211, 212 includes a charger 201, a developer unit 203, a cleaning blade 204, and an eraser 205. These are arranged around the photosensitive drum 25, and perform electrophotographic image forming processing other than fixing, i.e., charging, exposure, developing, transfer, cleaning, and charge elimination, with respect to an outer circumferential surface of the photosensitive drum 25.

The photosensitive drum 25 has an outer circumferential surface 251 that is a cylindrical member including an electrically conductive body such as aluminum covered by a photosensitive member. The photosensitive drum 25 is supported to be rotatable about a center axis 252 of the photosensitive drum 25 (in FIG. 3A, the center of the circular cross section of the photosensitive drum 25). The photosensitive member is a material whose amount of charge varies depending on exposure amount, and may be an inorganic material such as amorphous selenium, selenium alloy, or amorphous silicon, or an organic photoconductor (OPC) laminate structure of a plurality of organic materials. The center axis 252 of the photosensitive drum 25 is connected to a motor via a torque transmission mechanism such as gears, a belt, and the like. When the photosensitive drum 25 makes one rotation (in a clockwise direction in FIG. 3A) due to torque from said motor, each surface portion of the photosensitive member sequentially faces and is subjected to processing by the elements 201, 203, 204, 205.

The charger 201 includes an electrode 21E in the shape of a wire or thin sheet that extends in the axial direction of the photosensitive drum 25 and is disposed at an interval from the outer circumferential surface 251. The charger 201 applies, for example, a negative high voltage to the electrode 21E, thereby causing a corona discharge between the electrode 21E and the outer circumferential surface 251 of the photosensitive drum 25. Said discharge negatively charges a surface portion of the photosensitive member facing the charger 201.

As the photosensitive drum 25 rotates, the charged portion of the outer circumferential surface 251 moves from facing the charger 201 towards facing the developer unit 203. Inbetween, a linear region of the charged portion extending in the axial direction of the photosensitive drum 25, i.e., one line, is scanned by laser light by an exposure unit 26 (see FIG. 1B). At this time, the exposure unit 26 modulates laser light amount based on gradient values represented by image data. In one line of the photosensitive drum 25, the charge amount decreases as exposure amount increases, and therefore an electrostatic latent image is formed, i.e., a charge amount distribution corresponding to a gradient value distribution represented by the image data. Said operation with respect to one line is repeated by the exposure unit 26 in synchronization with rotation of the photosensitive drum 25. As a result, lines for which exposure is complete are made to be continuous in the rotation direction of the outer circumferential surface of the photosensitive drum 25, i.e., the sub-scanning direction, and the electrostatic latent image is enlarged two-dimensionally.

The developer unit 203 develops the electrostatic latent image on the photosensitive drum 25 with K color toner. The developer unit 203 first agitates with two auger screws 231, 232 the developer DVL that has flowed down from either of the hoppers 521, 522 from the outlet port 520 via the replenishing pipe 234, negatively charging the toner in the developer DVL through friction with the carrier. The developer unit 203 then transports the developer DVL via a developer roller 233 to a nip between the developer roller 233 and the photosensitive drum 25. In parallel, the developer unit 203 applies a high negative voltage to the developer roller 233. As a result, the potential of the area of the electrostatic latent image having a relatively small amount of charge is higher than the potential of the developer roller 233, and therefore an amount of toner corresponding to the difference in charge is separated from the developer carried on the developer roller 233 and attaches to the electrostatic latent image. In this way, the electrostatic latent image is visualized as a toner image.

The developer unit 203 includes a toner-carrier ratio (TCR) sensor 245 at a bottom of the developer unit 203. The TCR sensor 245 measures magnetic permeability of the developer DVL moving through the developer unit 203. Unlike carrier, toner is not magnetized, and therefore the higher the magnetic permeability of the developer DVL, the lower the ratio of toner to carrier, that is, the lower the toner concentration. Unlike toner, carrier is not consumed, and therefore toner concentration decreases as toner is consumed, and magnetic permeability of the developer DVL increases. Based on said relationship, toner concentration in the developer DVL is detected from a value measured by the TCR sensor 245, and the amount of the developer DVL to be supplied to the developer unit 203 is determined based on the detected value.

The toner image moves towards the nip between the photosensitive drum 25 and the primary transfer roller 22 as the photosensitive drum 25 rotates. A positive high voltage is applied to the primary transfer roller 22, and therefore the negatively charged toner image is transferred from the outer circumferential surface 251 of the photosensitive drum 25 to the intermediate transfer belt 23.

The cleaning blade 204 is a thin rectangular plate-shaped member made of a thermosetting resin such as polyurethane rubber, and a length of the cleaning blade is approximately equal in length to the portion of the outer circumferential surface 251 of the photosensitive drum 25 that is covered by photoreceptor. One long edge of a face of the blade 204 that faces the outer circumferential surface 251 of the photosensitive drum 25 is parallel to the axis of the photosensitive drum 25 and in contact with the outer circumferential surface 251 thereof, and scrapes off toner remaining on the outer circumferential surface 251 after transfer. Thus, the outer circumferential surface 251 is cleaned.

The eraser 205 is, for example, a light emitting diode (LED) disposed parallel to the axis direction of the photosensitive drum 25 that irradiates the outer circumferential surface 251 of the photosensitive drum 25 with light. Residual charge is eliminated from a portion of the outer circumferential surface 251 that is irradiated by said light. Thus, the outer circumferential surface 251 is neutralized.

[Electronic Control System of Image Forming Device]

Figure 4:
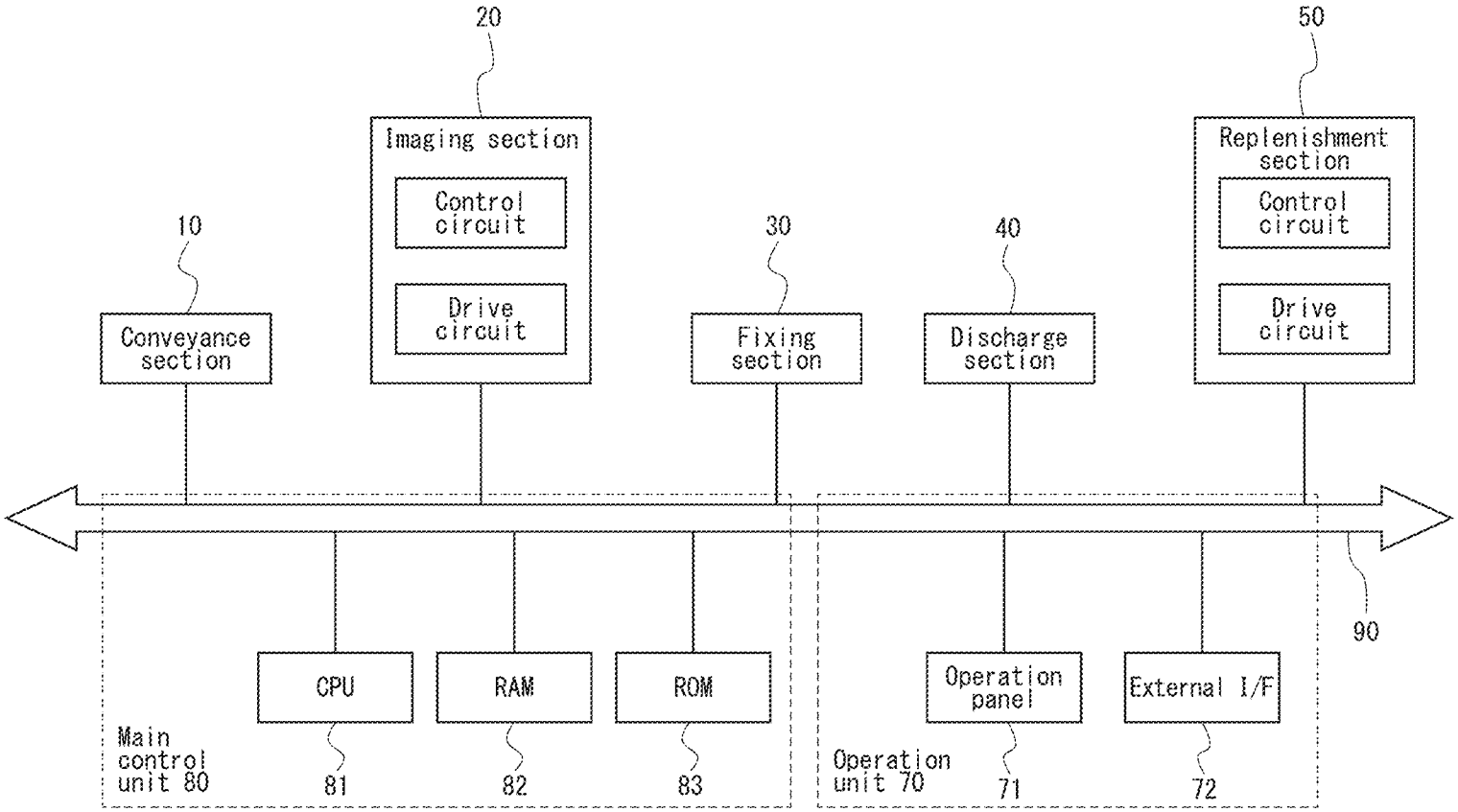
FIG. 4 is a block diagram illustrating a configuration of an electronic control system of the printer.

FIG. 4 is a block diagram illustrating a configuration of an electronic control system of the printer 130. The electronic control system, via a bus 90, connects and allows communication between an operation unit 70 and a main control unit 80 in addition to the feeder section 10, the imaging section 20, the fixing section 30, the discharge section 40, and the replenishment section 50.

The operation unit 70 is mounted on the MFP 100 and is an interface between the MFP 100 and a user or external electronic device, and accepts job processing requests and image data to be printed via user operation or communication with the external electronic device, and transmits same to the main control unit 80. The operation unit 70 includes an operation panel 71 and an external interface (I/F) 72. The operation panel 71 displays a graphical user interface (GUI) on a display thereof, detects a position of the display touched by the user with a touch panel or identifies a button pressed by the user according to the display, and transmits information related to same to the main control unit 80 as operation data. In particular, when a print job input screen is displayed on the display, the operation panel 71 receives from the user print conditions such as sheet size, type, orientation (portrait or landscape), number of copies, image quality, etc., and incorporates the print conditions into the operation data. The external I/F 52 reads image data to be printed directly from an external storage device such as a universal serial bus (USB) memory, hard disk drive (HDD), or the like through a USB port, memory card slot, or the like. The external I/F 52 further receives image data to be printed from an electronic device via a communication port connected by wired or wireless means to an external network.

The main control unit 80 is an integrated circuit mounted on one print circuit substrate housed in the printer 130, and includes a central processing unit (CPU) 81, a random access memory (RAM) 82, and a read-only memory (ROM) 83. The CPU 81 includes a microprocessor (MPU/CPU) and executes firmware. The RAM 82 is a volatile semiconductor storage device such as dynamic random access memory (DRAM) or static random access memory (SRAM). The RAM 82 provides a workspace when the CPU 81 executes firmware, and stores image data to be printed that is received by the operation unit 70. The ROM 83 comprises a combination of a read-only nonvolatile storage device and a rewritable nonvolatile storage device. The former stores firmware while the latter includes semiconductor storage devices such as electrically erasable programmable read-only memory (EEPROM), flash memory or a solid state drive (SSD) or a HDD, and provides a storage area for environmental variables and the like to the CPU 81.

The main control unit 80 controls the sections 10, 20, 30, 40, 50 in the printer 130 according to firmware executed by the CPU 81 and based on operation data from the operation unit 70. More specifically, the main control unit 80 causes the operation unit 70 to display an operation screen and accept user operations. According to said operations, the main control unit 80 determines an operation mode such as running mode, standby mode, or sleep mode, notifies the sections 10, 20, 30, 40, 50 of the operation mode with a drive signal, and causes execution of processing according to the operation mode. For example, when the operation unit 70 receives a print job, the main control unit 80 first causes the operation unit 70 to transfer image data to be printed to the RAM 82. The main control unit 80 then notifies the sections 10, 20, 30, 40, 50 to switch to the running mode, and designates parameter values required for processing according to print conditions. For example, the main control unit 80 designates type and count of sheets to be fed, and feed timing, to the feeder section 10, provides image data to the imaging section 20, and designates temperature of the fixing roller 31 to the fixing section 30. To the replenishment section 50, the main control unit 80 designates a permissible lower limit of toner concentration in developer according to print quality indicated in the print conditions.

—Replenishment Section Control System—

The feeder section 10, the imaging section 20, the fixing section 30, the discharge section 40, and the replenishment section 50 are each provided with a dedicated electronic control system. Each control system includes a control circuit and a drive circuit with respect to an actuator such as a motor or solenoid, and controls a drive force to be applied to a movable member of the corresponding section 10, 20, 30, 40, 50 by the actuator. Said movable members include the feed roller group 12 and the timing roller 13 of the feeder section 10, the drive pulley 23R, the photosensitive drum 25, the auger screws 231, 232, and the developer roller 233 of the imaging section 20, the fixing roller 31 and the pressure roller 32 of the fixing section 30, the discharge roller 43 of the discharge section 40, and the shafts 51S, the ejection screws 52E, and the transport screw 52C of the replenishment section 50. Said control circuits are each an electronic circuit such as an MPU/CPU, an application specific integrated circuit (ASIC), a field-programmable integrated circuit (FPGA), or the like, the control circuit setting a target value with respect to actuator output (control amount) according to a value of a parameter designated from the main control unit 80 and instructing a drive circuit. For example, according to drive control of a transport roller, a target value of voltage to be applied to a motor is indicated based on a target value of sheet transport speed designated by the main control unit 80 and an actual number of revolutions fed back from the motor. Further, timing of voltage application to the motor is designated according to a transport timing designated by the main control unit 80. Said drive circuits are each a switching converter, the drive circuit adjusting power supplied to an actuator by using a power transistor such as a field effect transistor (FET) or an insulated gate bipolar transistor (IGBT) as a switching element, such that output is maintained at a target value.

Operations to replenish developer by the replenishment section 50 are roughly divided into the following three types. (1) Storing developer in hoppers: causing developer of the toner bottles 601, 602 to be stored by the hoppers 521, 522 directly below. (2) Conveyance of developer to imaging section: conveying developer from the hoppers 521, 522 to the imaging units 211, 212 directly below. (3) Transport of developer between hoppers: moving developer from one of the hoppers 521, 522 to the other. In particular, operation type (3) allows switching of a destination of developer of the hoppers 521, 522 between the developer units 203 of the imaging units 211, 212.

(1) Storing Developer in Hoppers

In response to a notification from the main control unit 80 to switch to the running mode, the control system of the replenishment section 50 starts monitoring amounts of developer stored in the hoppers 521, 522. The control system periodically acquires, for example at intervals of several hundred milliseconds, an output signal from the toner sensor 52S included in either a default one of the hoppers 521, 522 or the one previously used in the operation mode. According to a level of the output signal, the control system performs the following control.

Figure 5A:
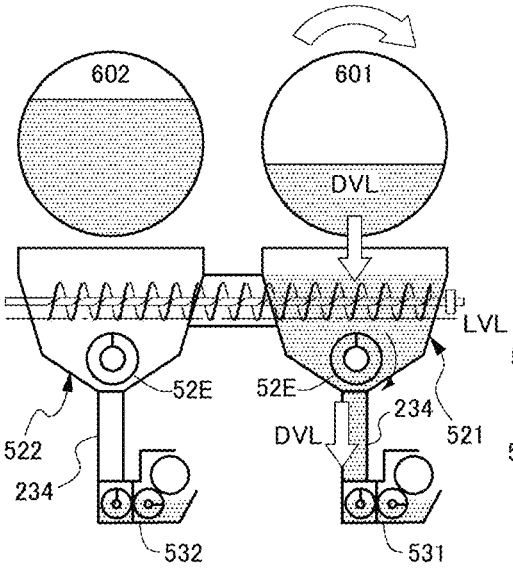
FIG. 5A is a schematic diagram illustrating normal operation of a replenishment section installed in the printer.

FIG. 5A is a schematic diagram illustrating an operation of the feeder section 50 under normal conditions. It is assumed that the first hopper 521 was used in the previous running mode. While an output signal level of the toner sensor 52S in the first hopper 521 does not indicate a near empty state, the interface between the developer DVL and air in the first hopper 521 is at least at a height LVL of the toner sensor 52S (also referred to as a "near empty level"). This means that a stored amount of the developer DVL is at least a permissible lower limit. In this case, the control system maintains both the shaft 52S connected to the first toner bottle 601 above the first hopper 521 and the ejection screw 52E in the first hopper 521 in stopped states.

As developer DVL is consumed in printing and the interface between the developer DVL and air in the first hopper 521 drops below the near empty level LVL, the output signal of the toner sensor 52S switches to a level indicating that the first hopper 521 is near empty. In response, the control system causes the shaft 52S connected to the first toner bottle 601 to rotate a certain number of times or for a certain time period. Accordingly, the control system updates a cumulative value of number of revolutions or rotation time from start of use of the first toner bottle 601. On the other hand, the control system maintains the ejection screw 52E in the first hopper 521 in a stopped state. As a result, as long as a sufficient amount of the developer DVL remains in the first toner bottle 601, the developer DVL is supplied from the first toner bottle 601 to the first hopper 521 in an amount corresponding to the certain number of revolutions or rotation time of the first toner bottle 601.

Said replenishment operation is repeated until the output signal level of the toner sensor 52S switches again, but only up to an upper limit of a defined number of times or for a defined time period. The product of the upper limit of the number of replenishment operation repetitions and the number of revolutions for one replenishment operation is at least a representative value (for example, an average value) that is statistically representative of the number of revolutions required to move developer from an inside of a bottom of the first toner bottle 601 to the outlet port 60H. The product of the upper limit of the number of replenishment operation repetitions and the time period for one replenishment operation, and an upper limit of replenishment time are at least representative values that are statistically representative of the time required to move developer from the inside of the bottom of the first toner bottle 601 to the outlet port 60H. Thus, if the output signal level of the toner sensor 52S is switched prior to reaching or upon reaching the upper limit of number of replenishment operations or replenishment operation time, the stored amount of the developer DVL in the first hopper 521 returns at least to the permissible lower limit.

Figure 5B:
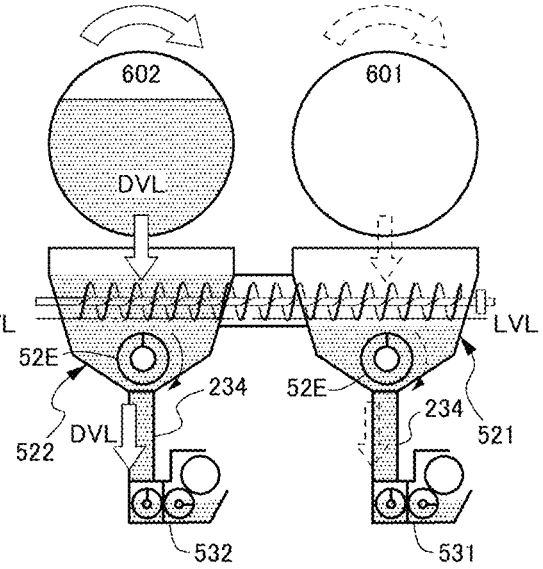
FIG. 5B is a schematic diagram illustrating operation of the replenishment section when a first toner bottle is empty.

FIG. 5B is a schematic diagram illustrating operation of the replenishment section 50 when the first toner bottle 601 is empty. If the output signal level of the toner sensor 52S is not switched even when the replenishment operation has been repeated for the upper limit of repetitions or time, the control system determines that the first toner bottle 601 is empty, and notifies the main control unit 80 of same (out of toner). The same is true when the output signal level of the toner sensor 52S does not switch even when the cumulative value of the number of revolutions or the rotation time from the start of use of the first toner bottle 601 reaches the upper limit, i.e., when a value sufficient to indicate that all the developer has flowed out from the first toner bottle 601 has been reached. In response to this notification from the replenishment section 50, the main control unit 80 instructs the imaging section 20 to cause operation of the second imaging unit 212 instead of the first imaging unit 211, and notifies the replenishment section 50 to switch from the first imaging unit 211 to the second imaging unit 212. In response to this notification, the control system of the replenishment section 50 switches the developer storage amount monitoring from the first hopper 521 to the second hopper 522. That is, an output signal acquisition target changes from the toner sensor 52S in the first hopper 521 to the toner sensor 52S of the second hopper 522. The control system also maintains the shaft 52S connected to the bottom of the first toner bottle 601 and the ejection screw 52E in the first hopper 521 in a stopped state until replacement of the first toner bottle 601 is detected via the mechanical switch of the hole 51H of the frame 51F. Subsequently, the replenishment section 50 performs the operation described above with respect to the first hopper 521 and the first toner bottle 601, that is, performs the same operation as the developer storage control with respect to the first hopper 521, but with respect to the second hopper 522 and the second toner bottle 602.

The control system of the replenishment section 50 switching a target of developer storage control between the hoppers 521, 522 is not limited to a case in which either of the toner bottles 601, 602 becomes empty, and switching also occurs when a malfunction occurs in operation of one of the imaging units 211, 212. Details are described later.

(2) Conveyance of Developer to Imaging Section

The control system of the replenishment section 50 receives from the main control unit 80, along with notification to switch to the running mode, designation of the permissible lower limit of toner concentration in developer with respect to the developer unit 203 to be used in printing by the corresponding one of the imaging units 211, 212. According to said designation, the control system supplies developer to the developer unit 203 used for printing, such that the toner concentration in the developer stored therein is kept at or above the permissible lower limit. More specifically, the control system first periodically acquires from the control system of the imaging section 20 a measured value measured by the TCR sensor 245 in the developer unit 203 used for printing at intervals of, for example, several seconds, and from the measured value detects the toner concentration in the developer. The control system then calculates a developer replenishment amount from a difference between the detected value and the designated permissible lower limit value.

For example, a situation is supposed in which the developer replenishment amount with respect to a developer unit 531 of the first imaging unit illustrated in FIG. 5A (also referred to as a first developer unit) is equal to or greater than a threshold value. The threshold value represents, for example, a minimum amount of developer that can be fed to the replenishing pipe 234 of the first developer unit with sufficient accuracy according to rotation control of the ejection screw 52E. The control system first checks the output signal level of the toner sensor 52S in the first hopper 521. If the output signal level indicates that the first hopper 521 is near empty, the control system performs the replenishment operation (1) with respect to the first hopper 521. If the output signal level does not indicate that the first hopper 521 is near empty, the control system causes the ejection screw 52E in the first hopper 521 to rotate as illustrated in FIG. 5A. The control system continues this rotation for a number of times or a period of time necessary to feed the replenishment amount of developer to the replenishing pipe 234. Thus, the replenishment amount of the developer DVL is conveyed from the first hopper 521 to the first developer unit 531 via the replenishing pipe 234.

Even during rotation of the ejection screw 52E, control of developer stored in the first hopper 521 occurs in parallel. When the output signal level of the toner sensor 52S in the first hopper 521 indicates near empty, the control system of the replenishment section 50 determines whether or not the first toner bottle 601 is empty. That is, the control system determines whether or not the output signal level of the toner sensor 52S switches, and whether the cumulative value of the number of rotations or the rotation time from the start of use of the first toner bottle 601 remains below the permissible upper limit, by the point the replenishment operation is repeated the upper limit of times or for the upper limit of time. Upon determining that the first toner bottle 601 is empty, the control system stops the ejection screw 52E and stops conveyance of developer from the first hopper 521 to the replenishing pipe 234. Subsequently, along with operation of the second imaging unit 212 instead of the first imaging unit 211, the replenishment section 50 conveys developer DVL from the second hopper 522 to a developer unit 532 of the second imaging unit (also referred to as a second developer unit) similarly to the operation described above.

Figure 5C:
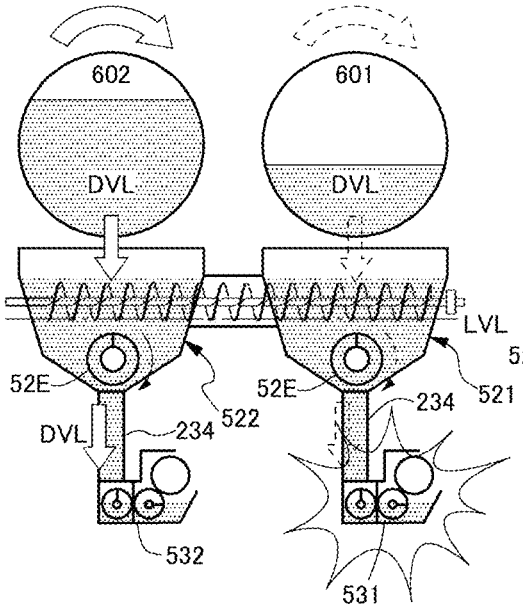
FIG. 5C is a schematic diagram illustrating operation of the replenishment section when a malfunction has occurred in a first developer unit during operation.

FIG. 5C is a schematic diagram illustrating operation of the replenishment section 50 when a malfunction occurs in operation of the first developer unit 531. The control system of the imaging section 20 continues to accumulate a total use time of each of the first developer unit 531 and the second developer unit 532, and a number of revolutions or revolution time from start of use of each of the developer rollers 233. When any of said cumulative values reaches a permissible upper limit, for example when the cumulative value with respect to the first developer unit 531 reaches a permissible upper limit and the control system of the imaging unit 20 determines that the first developer unit 531 has reached the end of its life, the control system notifies the main control unit 80 of same (developer unit malfunction). The same is true when the first developer unit 531 becomes inoperable due to a failure. In response to such notification, the main control unit 80 instructs the imaging section 20 to operate the second imaging unit 212 instead of the first imaging unit 211, and notifies the replenishment section 50 of the switching of imaging units. In response to said notification, the control system of the replenishment section 50 stops the ejection screw 52E in the first hopper 521, and subsequently prohibits conveyance of developer from the first hopper 521 to the replenishing pipe 234 until replacement of the first developer unit 531 is detected by the imaging section 20. The same is true if malfunction of the second developer unit 532 occurs in operation. The control system also switches a target of developer replenishment operations (1) from the first hopper 521 to the second hopper 522. Thus, similarly to the situation in which the first bottle 601 becomes empty (see FIG. 5B), instead of a combination of the first bottle 601, the first hopper 521, and the first developer unit 531, a combination of the second toner bottle 602, the second hopper 522, and the second developer unit 532 is used for printing.

(3) Transport of Developer Between Hoppers

As illustrated in FIG. 5C, when a malfunction occurs in the first developer unit 531, the second imaging unit 212 operates instead of the first imaging unit 211, and therefore developer in the second hopper 522 starts being consumed in printing instead of developer in the first hopper 521. At this time, an amount of developer may remain in the first toner bottle 601, and may remain in the first hopper 521.

Figure 5D:
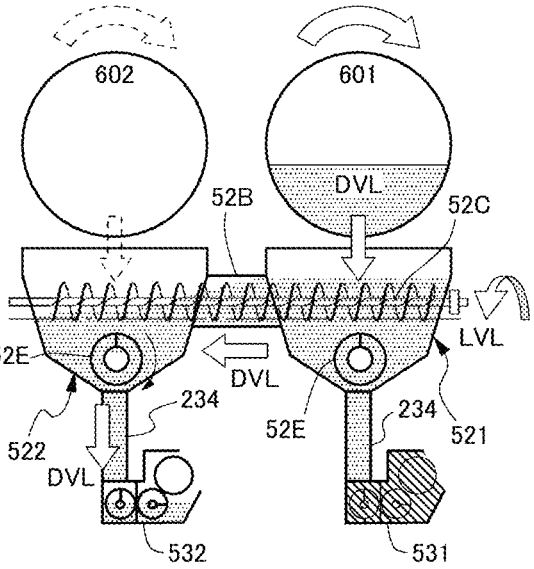
FIG. 5D is a schematic diagram illustrating operation of the replenishment section when a 2nd toner bottle becomes empty after the first developer unit malfunctions.

FIG. 5D is a schematic diagram illustrating operation of the replenishment section 50 when the second toner bottle 602 becomes empty due to developer replenishment after a malfunction of the first developer unit 531. Due to operation of the second imaging unit 212 instead of the first imaging unit 211, the second toner bottle 602 may become empty before the first toner bottle 601. In this case, in order to utilize as much as possible the developer remaining in the first toner bottle 601 and the first hopper 521, the replenishment section 50 transports developer from the first hopper 521 to the second hopper 522 via the connecting path 52B, as described below.

When determining that the second toner bottle 602 is empty, the control system of the replenishment section 50 notifies the main control unit 80 of same, as described above regarding the replenishment operation (1). In response to this notification, the main control unit 80 causes the imaging section 20 to check whether the first imaging unit 211 that is currently stopped is operable as a substitute for the second imaging unit 212. At this time, if the first imaging unit 211 has already been replaced and is operable, the main control unit 80 instructs the imaging section 20 to cause operation of the first imaging unit 211 instead of the second imaging unit 212, as described above regarding the replenishment operation (1). However, if the first imaging unit 211 is still inoperable, the main control unit 80 notifies the replenishment section 50 that there is no substitute for the second imaging unit 212. In response to this notification, the control system of the replenishment section 50 first checks the output signal level of the toner sensor 52S in the first hopper 521. If the output signal level indicates that the first hopper 521 is near empty, the control system performs the replenishment operation (1) with respect to the first hopper 521. If, as a result, the output signal level of the toner sensor 52S in the first hopper 521 switches to a level that indicates that the first hopper 521 is not near empty, or is already at such a level, the interface between the developer DVL and air in the first hopper 521 is at or above the near empty level LVL, and in particular is at a height at which transport of the developer DVL by the transport screw 52C is possible. Next, as illustrated in FIG. 5D, the control system causes the transport screw 52C to continuously rotate for a certain number of times or for a certain period of time in a direction that transports the developer DVL from the first hopper 521 to the second hopper 522 via the connecting path 52B. On the other hand, the control system maintains the ejection screw 52E in the second hopper 522 in a stopped state. Thus, as long as a sufficient amount of the developer DVL remains in the first hopper 521, an amount of the developer DVL that depends on the certain number of rotations or rotation time of the transport screw 52C is transported from the first hopper 521 to the second hopper 522. Meanwhile, the control system periodically, for example at intervals of several hundred milliseconds, acquires output signals from the toner sensors 52S of the hoppers 521, 522. Until the output signal level of either of the toner sensors 52S switches, the transport operation is repeated.

If the output signal level of the toner sensor 52S in the second hopper 522 switches first, the interface between the developer DVL and air in the second hopper 522 is restored to a position at or above the near empty level LVL. Accordingly, the control system stops the transport screw 52C and restarts conveyance of developer from the second hopper 522 to the second developer unit 532. Thus, the destination of developer from the first toner bottle 601 and the first hopper 521 is switched from the first developer unit 531 to the second developer unit 532, and developer remaining in the first toner bottle 601 and the first hopper 521 is used for printing. The control system also causes the transport screw 52C to stand by until the interface between the developer and air falls below the near empty level LVL and the output signal level of the toner sensor 52S in the second hopper 522 again indicates that the second hopper 522 is near empty.

If the output signal level of the toner sensor 52S in the first hopper 521 switches first, the interface between the developer DVL and air in the first hopper 521 is lower than the near empty level LVL, and in particular below a height at which transport of the developer DVL by the transport screw 52C is possible. Accordingly, the control system temporarily stops the transport screw 52C and performs replenishment of developer with respect to the first hopper 521. If, as a result, the output signal of the toner sensor 52S in the first hopper 521 switches to a level that does not indicate near empty, the control system again causes the transport screw 52C to transport the developer DVL from the first hopper 521 to the second hopper 522. If the output signal level of the toner sensor 52S in the first hopper 521 does not switch even after the replenishment operation with respect to the first hopper 521 is repeated an upper limit of times or for an upper limit of time, the control system determines that the first toner bottle 601 is empty, and notifies the main control unit 80 of same (out of toner). In response to this notification, the main control unit 80 stops operation of the printer 130, and causes the display panel 71 to display an out-of-toner error and prompt the user to replace both the toner bottles 601, 602. The control system of the replenishment section 50 causes the replenishment section 50 to stand by until replacement of either of the toner bottles 601, 602 is detected via the mechanical switch of the hole 51H of the frame 51F.

[Replenishment Section Operation Flow]

The control system of the replenishment section 50 causes an associated CPU to execute firmware stored in an associated ROM. According to said firmware, the replenishment unit 50 implements replenishment of developer to the developer units 531, 532 from the toner bottles 601, 602 by combining the three types of operations (1), (2), (3) as follows.

Figure 6:
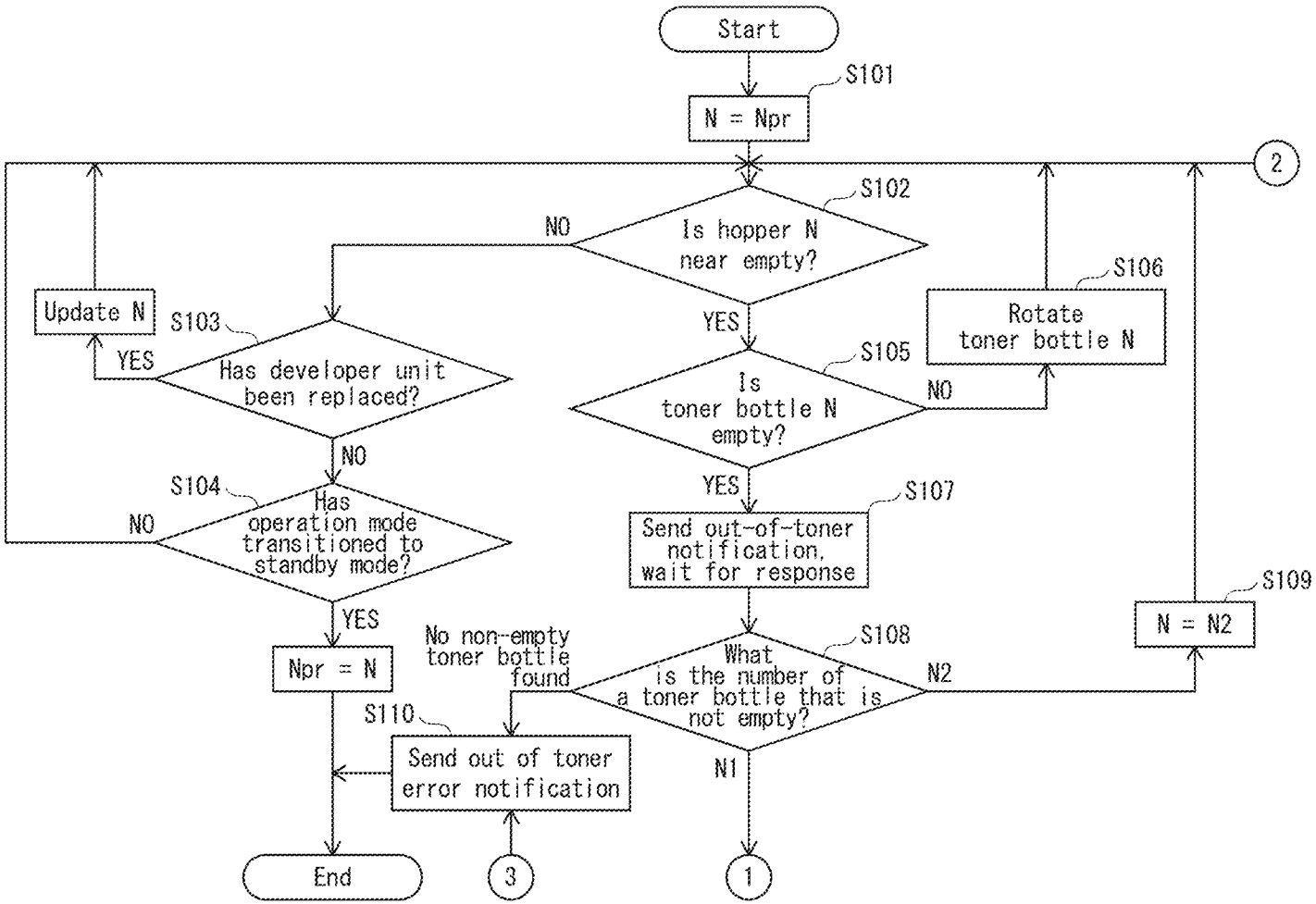
FIG. 6 is a flowchart of control processing from toner bottles to hoppers with respect to conveying developer.

FIG. 6 is a flowchart of control processing with respect to conveyance of developer from the toner bottles 601, 602 to the hoppers 521, 522. The control system of the replenishment section 50 starts this processing in response to a notification from the main control unit 80 to switch to the running mode.

In step S101, the control system reads an identification number Npr of a hopper from an associated ROM, for example, and sets storage area of an integer variable N stored in an associated RAM to N=Npr. The identification number Npr is a serial number assigned to a default hopper or a hopper used in the previous running mode, among individual serial numbers assigned to the hoppers 521, 522. For example, if the first hopper 521 is assigned an identification number "1", and the second hopper 522 is assigned an identification number "2", the values of the variables Npr and N will be "1" or "2". According to the setting in step S101, a hopper N becomes a developer storage amount monitoring target. Processing then proceeds to step S102.

Identification numbers are also assigned to toner bottles installed in the replenishment section 50 and to imaging units. In the following description, in order to simplify explanation, it is assumed that a toner bottle disposed directly above the hopper N and an imaging unit connected to the hopper N via the replenishing pipe 234 are assigned the same identification number N.

In step S102, the control system determines whether or not the output signal level of the toner sensor 52S in the hopper N is indicating near empty. At this time, if a defined period has not elapsed since the previous check, for example if several hundred milliseconds have not elapsed, the control system stands by until the defined period has elapsed. When the output signal level is not indicating that the hopper N is near empty, processing proceeds to step S103, and when the output signal level is indicating that the hopper N is near empty, processing proceeds to step S105.

In step S103, the output signal level of the toner sensor 52S in the hopper N is not indicating near empty, and therefore the interface between developer and air in the hopper N is positioned at or above a near empty level LVL. The control system determines whether or not notification of replacement of an imaging unit due to a developer unit malfunction has been received from the main control unit 80. If notification of said replacement has been received, the control system updates the integer value variable N with the identification number of the imaging unit after replacement, and processing returns to step S102. If notification of said replacement has not been received, processing proceeds to step S104.

In step S104, the control system determines whether or not a notification of switching to standby mode from running mode due to job processing ending has been received from the main control unit 80. Without said notification, processing returns to step S102. If said notification has been received, the control system saves in ROM the integer value variable N as the identification number Npr of a hopper that is to be a developer storage amount monitoring target in the next running mode, i.e., Npr=N. Subsequently, processing ends.

In step S105, the output signal level of the toner sensor 52S in the hopper N is indicating near empty, and therefore the interface between developer and air in the hopper N is positioned below a near empty level LVL. The control system determines whether or not the toner bottle N is empty. More specifically, the control system determines whether or not a number of repetitions or time of a replenishment operation (step S106) has reached an upper limit, and whether or not a cumulative value of number of revolutions or revolution time since start of usage of the toner bottle N has reached a permissible upper limit. If the number of repetitions or time is less than the upper limit and the cumulative value is less than the permissible upper limit, it is determined that the toner bottle N is not empty, and processing proceeds to step S106. If the number of repetitions or time has reached the upper limit, or the cumulative value has reached the permissible upper limit, it is determined that the toner bottle N is empty, and processing proceeds to step S107.

In step S106, the toner bottle N is not empty, and therefore the control system causes the shaft 52S connected to the toner bottle N to continuously rotate for a certain number of times or for a certain time. Accordingly, the control system updates the cumulative value of number of revolutions or rotation time from start of use of the toner bottle N. On the other hand, the control system maintains the ejection screw 52E in the hopper N in a stopped state. Accordingly, as long as sufficient developer remains in the toner bottle N, an amount of toner corresponding to the certain number of revolutions or revolution time of the toner bottle N is supplied to the hopper N from the toner bottle N. Processing then returns to step S102.

In step S107, the toner bottle N is empty, and therefore the control system notifies the main control unit 80 of same (out of toner) and writes same to a toner bottle state recording area of an associated RAM. In response to said notification, the main control unit 80 checks the imaging section 20 for presence or absence of a substitute for the imaging unit N. If a substitute is present, the main control unit 80 selects an imaging unit N2 (N2≠N), instructs the imaging section 20 to cause operation of the imaging unit N2, and notifies the replenishment unit 50 to switch from the imaging unit N to the imaging unit N2. If a substitute is not present, the main control unit 80 causes the imaging section 20 to continue operating the imaging unit N, and notifies the replenishment section 50 of same. When the control system of the replenishment section 50 receives either of said notifications, processing proceeds to step S108.

In step S108, when the notification from the main control unit 80 indicates switching from the imaging unit N to the imaging unit N2, the control system of the replenishment section 50 refers to the toner bottle state recorded in an associated RAM to check whether or not the toner bottle N2 is empty. If the toner bottle N2 is not empty, processing proceeds to step S109. If the toner bottle N2 is empty (including when a toner bottle is not installed to the holder 51), or when the notification from the main control unit 80 indicates continued operation of the imaging unit N, the control system of the replenishment section 50 searches for an identification number in RAM of a toner bottle that is not empty. If all toner bottles are empty, processing proceeds to step S110. When an identification number N1 (N1≠N2 or N) of a toner bottle that is not empty is detected, processing proceeds to a developer destination switching control (described later, see FIG. 7).

In step S109, the toner bottle N2 is not empty, and therefore the control system updates the integer value variable N with the identification number N2, i.e., N=N2. Thus, the hopper N2 becomes the developer storage amount monitoring target. Processing then returns to step S102.

In step S110, all toner bottles installed in the holder 52 are empty, and therefore the control system of the replenishment section 50 notifies the main control unit 80 of same (out-of-toner error). In response to said notification, the main control unit 80 causes the operation panel 71 to display an out-of-toner error, and subsequently stops operation of all elements in the printer 130 including the replenishment section 50. Subsequently, processing ends.

Figure 7:
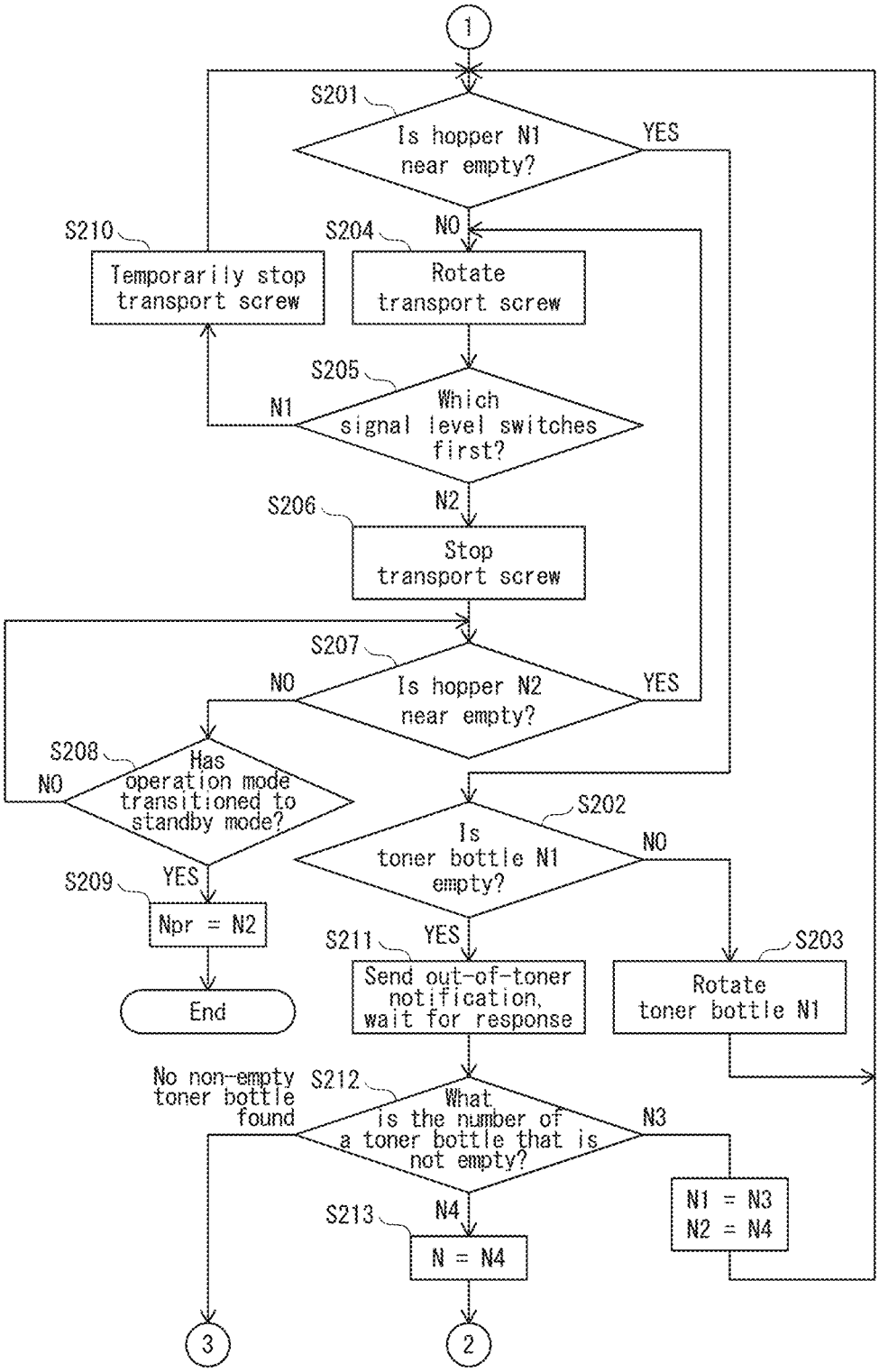
FIG. 7 is a flowchart of control processing from toner bottles to hoppers with respect to switching of destinations of developer.

FIG. 7 is a flowchart of control processing from the toner bottles 601, 602 to the hoppers 521, 522 with respect to switching of destinations of developer.

In step S201, the toner bottle having the same identification number N2 as a substitute imaging unit is empty, but the toner bottle N1 having a different identification number to the substitute imaging unit is not empty. The control system of the replenishment section 50 determines whether or not the output signal level of the toner sensor 52S in the hopper N1 is indicating near empty. At this time, if a defined period has not elapsed since the previous check, for example if several hundred milliseconds have not elapsed, the control system stands by until the defined period has elapsed. When the output signal level is indicating that the hopper N1 is near empty, processing proceeds to step S202, and when the output signal level is not indicating that the hopper N1 is near empty, processing proceeds to step S204.

In step S202, the output signal level of the toner sensor 52S in the hopper N1 is indicating near empty, and therefore the interface between developer and air in the hopper N1 is positioned below a near empty level LVL. The control system determines whether or not the toner bottle N1 is empty. More specifically, the control system determines whether or not a number of repetitions or time of a replenishment operation (step S203) has reached an upper limit, and whether or not a cumulative value of number of revolutions or revolution time since start of usage of the toner bottle N1 has reached a permissible upper limit. If the number of repetitions or time is less than the upper limit and the cumulative value is less than the permissible upper limit, it is determined that the toner bottle N1 is not empty, and processing proceeds to step S203. If the number of repetitions or time has reached the upper limit, or the cumulative value has reached the permissible upper limit, it is determined that the toner bottle N1 is empty, and processing proceeds to step S211.

In step S203, the toner bottle N1 is not empty, and therefore the control system causes the shaft 52S connected to the toner bottle N1 to continuously rotate for a certain number of times or for a certain time. Accordingly, the control system updates the cumulative value of number of revolutions or rotation time from start of use of the toner bottle N1. On the other hand, the control system maintains a stopped state of the transport screw 52C. Accordingly, as long as sufficient developer remains in the toner bottle N1, an amount of toner corresponding to the certain number of revolutions or revolution time of the toner bottle N1 is supplied to the hopper N1 from the toner bottle N1. Processing then returns to step S201.

In step S204, the output signal level of the toner sensor 52S in the hopper N1 is not indicating near empty, and therefore the interface between developer and air in the hopper N1 is positioned at or above a near empty level LVL. The control system causes the transport screw 52C to continuously rotate for a certain number of times or a certain time in a direction that transports developer from the hopper N1 to the hopper N2 via the connecting path 52B. On the other hand, the control system maintains the ejection screw 52E in the hopper N2 in a stopped state. Thus, as long as sufficient developer remains in the hopper N1, an amount of developer corresponding to the certain number of rotations or rotation time of the transport screw 52C is transported from the hopper N1 to the hopper N2. Processing then proceeds to step S205.

In step S205, during the transport operation of step S204, the control system periodically, for example at intervals of several hundred milliseconds, acquires output signals from the toner sensors 52S in the hopper N1 and the hopper N2. If the output signal level of the toner sensor 52S in the hopper N2 switches first, processing proceeds to step S206, but if the output signal level of the toner sensor 52S in the hopper N1 switches first, processing proceeds to step S210.

In step S206, the output signal level of the toner sensor 52S in the hopper N2 switched first, and therefore the interface between developer and air in the hopper N2 has returned to at or above a near empty level LVL. Accordingly, the control system causes the transport screw 52C to stop. Processing then proceeds to step S207.

In step S207, the control system determines whether or not the output signal level of the toner sensor 52S in the hopper N2 is indicating near empty. At this time, if a defined period has not elapsed since the previous check, for example if several hundred milliseconds have not elapsed, the control system stands by until the defined period has elapsed. When the output signal level is indicating that the hopper N2 is near empty, processing proceeds to step S204, and when the output signal level is not indicating that the hopper N2 is near empty, processing proceeds to step S208.

In step S208, the control system determines whether or not a notification of switching to standby mode from running mode due to job processing ending has been received from the main control unit 80. If said notification has been received, processing proceeds to step S209, and if said notification has not been received, processing returns to step S207.

In step S209, notification to switch to standby mode has been received from the main control unit 80, and therefore the control system stores in ROM the identification number N2 of the imaging unit used in printing as the identification number Npr of a hopper to be the developer storage amount monitoring target in the next running mode, i.e., Npr=N2. Subsequently, processing ends.

In step S210, the output signal level of the toner sensor 52S in the hopper N1 switched first, and therefore the interfaces between developer and air in both the hopper N1 and the hopper N2 have dropped below a near empty level LVL. Accordingly, the control system causes the transport screw 52C to stop. Processing then returns to step S201.

In step S211, the toner bottle N1 is empty, and therefore the control system notifies the main control unit 80 of same (toner out) and writes same to a toner bottle state recording area of an associated RAM. In response to said notification, the main control unit 80 checks the imaging section 20 for presence or absence of a substitute for the imaging unit N2. If a substitute is present, the main control unit 80 selects one, instructs the imaging section 20 to cause operation of the substitute, and notifies the replenishment unit 50 to switch from the imaging unit N2 to the substitute. If a substitute is not present, the main control unit 80 notifies the replenishment section 50 of same. When the control system of the replenishment section 50 receives either of said notifications, processing proceeds to step S212.

In step S212, if notification that a substitute imaging unit is present is received from the main control unit 80, the control system of the replenishment section 50 refers to the toner bottle state recorded in an associated RAM, and checks whether or not a toner bottle having the same identification number N4 as the substitute imaging unit is empty. If the toner bottle N4 is not empty, processing proceeds to step S213. If the toner bottle N4 is empty (including when a toner bottle is not installed to the holder 52), or when the notification from the main control unit 80 indicates that no substitute imaging unit is present, the control system of the replenishment section 50 searches for an identification number in RAM of a toner bottle that is not empty. If all toner bottles are empty, processing proceeds to step S110 (see FIG. 6). When an identification number N3 (N3≠N4) of a toner bottle that is not empty is detected, the identification number N1 of the toner bottle to be used is overwritten by the identification number N3. Further, the identification number N2 of the imaging unit used in printing is overwritten by the identification number N4 of the substitute imaging unit, and processing returns to step S201.

In step S213, the toner bottle that has the same identification number N4 as the substitute imaging unit is not empty, and therefore developer transport control between hoppers is unnecessary. Accordingly, the identification number N4 is set as the integer value variable N (N=N4), and processing returns to step S102 (see FIG. 6).

Figure 8:
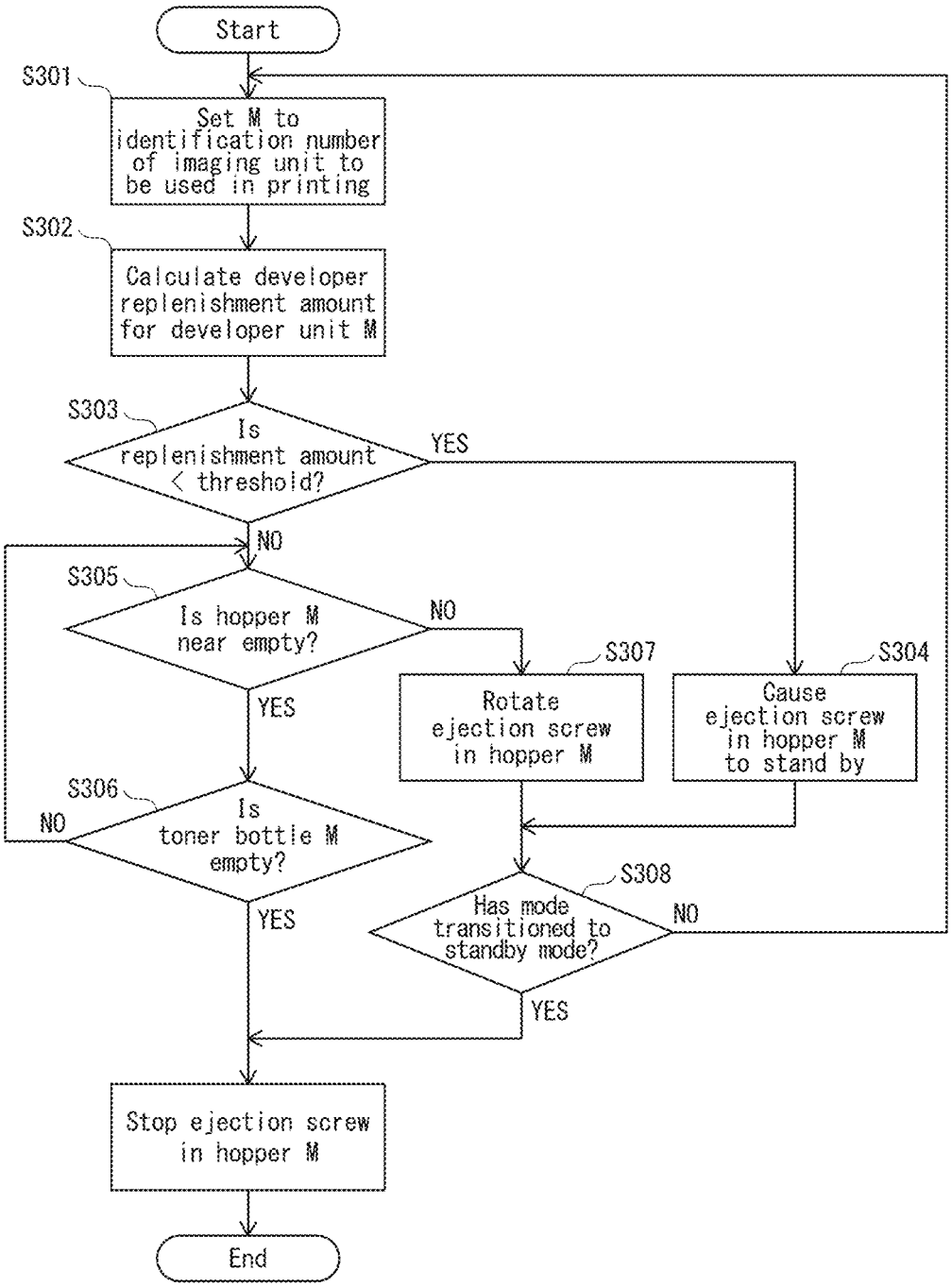
FIG. 8 is a flowchart of control processing from hoppers to developer units with respect to conveying developer.

FIG. 8 is a flowchart of control processing from the hoppers 521, 522 to the developer units 531, 532, with respect to conveyance of developer. The control system of the replenishment section 50 starts this processing when a permissible lower limit of toner concentration in developer in a developer unit used in printing is designated along with notification of transition to the running mode from the main control unit 80.

In step S301, the control system identifies which developer unit of the imaging units 211, 212 the permissible lower limit of developer concentration designated by the main control unit 80 is designated for, and sets the identification number of the identified imaging unit in a storage area of an integer value variable M of an associated RAM. Processing then proceeds to step S302.

In step S302, the control system acquires the measured value of the TCR sensor 245 in a developer unit M used in printing from the control system of the imaging section 20, and detects toner concentration in developer from the measured value. At this time, if a defined period has not elapsed since the previous acquisition, the control system stands by until the defined period has elapsed. The control system then calculates a developer replenishment amount from a difference between the detected toner concentration value and the designated permissible lower limit value. Processing then proceeds to step S303.

In step S303, the control system determines whether or not the developer replenishment amount with respect to the developer unit M is less than a threshold value. If the replenishment amount is less than the threshold value, processing proceeds to step S304, and if the replenishment amount is greater than or equal to the threshold value, processing proceeds to step S305.

In step S304, the developer replenishment amount with respect to the developer unit M is less than the threshold value, which is too small an amount to sufficiently accurately supply to the replenishing pipe 234 of the developer unit M via rotation control of the ejection screw 52E. Accordingly, the control system causes the ejection screw 52E in the hopper M to stand by in a stopped state. Processing then proceeds to step S308.

In step S305, the developer replenishment amount with respect to the developer unit M is equal to or greater than the threshold value. The control system checks whether or not an output signal level of the toner sensor 52S in the hopper M indicates near empty, the hopper M being checked in a developer storage control performed in parallel with respect to the hopper M (see FIG. 6, FIG. 7). When the output signal level is indicating that the hopper M is near empty, processing proceeds to step S306, and when the output signal level is not indicating that the hopper M is near empty, processing proceeds to step S307.

In step S306, the output signal level of the toner sensor 52S in the hopper M is indicating near empty. When it is determined that the toner bottle M is empty in the developer storage control performed in parallel with respect to the hopper M, the control system stops the ejection screw 52E to stop conveyance of developer from the hopper M to the replenishing pipe 234. Subsequently, processing ends. On the other hand, when the control system determines that the toner bottle M is not empty, processing returns to step S305.

In step S307, the output signal level of the toner sensor 52S in the hopper M is not indicating near empty. The control system continuously rotates the ejection screw 52E in the hopper M for a number of times or for a time required to feed the replenishment amount of developer to the replenishing pipe 234 of the developer unit M. Thus, the replenishment amount of developer is conveyed from the hopper M to the developer unit M via the replenishing pipe 234. Processing then proceeds to step S308.

In step S308, the control system checks whether or not a notification to transition from the running mode to the standby mode due to job processing ending has been received from the main control unit 80, and whether or not a notification of switching the imaging unit used in printing has been received from the main control unit 80. If either notification has been received, processing ends, and if neither notification has been received, processing returns to step S302.

Merits of Embodiment

As described above, in the printer 130 according to at least one embodiment of the present disclosure, the first developer unit 531 and the second developer unit 532 each develop a latent image on the photosensitive drum 25 into a K color image. That is, the developer units 531, 532 provide redundancy for monochrome printing. Likewise, the toner bottles 601, 602 and the hoppers 521, 522 provide redundancy. If either of the toner bottles 601, 602 become empty, or if either of the developer units 531, 532 reach the end of their life or malfunction due to a failure, a set of a toner bottle, a hopper, and a developer unit can be switched for a spare set. Thus, the printer 130 can continue printing without downtime. Further, the hoppers 531, 532 are connected by the connecting path 52B, and the transport screw 52C that passes through the connecting path 52B can transport developer between the hoppers 531, 532 in either direction. Thus, for developer from either of the toner bottles 601, 602, the replenishment section 50 can switch a developer destination between the first developer unit 531 and the second developer unit 532. Accordingly, if for example a malfunction of the first developer unit 531 occurs and the second developer unit 532 is substituted, even if the second toner bottle 602 is empty, developer can be replenished from the first toner bottle 601 to the second developer unit 532. Thus, the printer 130 can continue printing without downtime. Thus, with respect to image developing, the printer 130 has high maintainability and availability.

The printer 130 is also a device in which the structure of a tandem type full color device is repurposed as a monochrome specific device. Accordingly, in addition to the holder 51 and the conveyance unit 52, the first developer unit 531 and the second developer unit 532 can easily be repurposed from the structure of a holder, a conveyance unit, and developer units of a full color device. Thus, an increase in manufacturing cost due to factors such as an increase in number of parts due to added redundancy and complication of manufacturing can be cancelled out by a decrease in maintenance cost due to improved maintainability and availability with respect to image development.

As described above, by providing developer unit redundancy to a space previously occupied by mechanisms removed from a structure originally that of a full color device, the printer 130 does not excessively increase manufacturing cost. That is, it is possible to effectively utilize a wide range of space inside the casing without compromising on the inexpensiveness of a monochrome specific device.

[Modifications]

(A) The image forming device 100 illustrated in FIG. 1 is an MFP. The image forming device according to an embodiment of the present disclosure may be a single function device such as a printer, copier, or facsimile machine.

(B) The replenishment section 50 considers a toner bottle to be empty when the output signal level of the toner sensor 52S does not switch even after a developer replenishment operation from one of the toner bottles 601, 602 to one of the hoppers 521, 522 directly below is repeated an upper limit of times or for an upper limit of time, and when a cumulative value of the number of revolutions or revolution time since the usage start time of the toner bottle reaches a permissible upper limit. The replenishment section 50 may measure an amount of developer in each of the toner bottles 601, 602 by using a toner sensor or TCR sensor provided to the holder 51, and may calculate an amount of developer in each of the toner bottles 601, 602 from a load torque received by a drive motor through the shaft 52S.

(C) The hoppers 521, 522 included in the storage 52T of the replenishment section 50 are repurposed hoppers of a tandem type full color device, and are connected to each other by the connecting path 52B. If the entire structure of the hoppers 521, 522 and the connecting path 52B is regarded as a single container, the inside of the container is divided into two rooms by the connecting path 52B, where each room is the space inside one of the hoppers 521, 522. Storage according to the present disclosure may have this structural feature. For example, instead of the hoppers 521, 522, the storage may include a single large container spanning the entirety of the space occupied by the hoppers 521, 522. The interior of this container may be divided into two rooms by a partition, for example, and each room may have a structure in which developer flowing out from a different one of the toner bottles 601, 602 is temporarily stored.

In the storage 52T of the replenishment section 50 are one of the connecting path 52B and one of the transport screw 52C. Two or more of one or both of the connecting path 52B and the transport screw 52C may be provided. In a case where two or more of the transport screws 52C are provided, each of the transport screws 52C may be configured to rotate in only one direction to transport developer in only one direction. If a pair of screws rotate in opposite directions, developer can be transported between two rooms in both directions.

(D) In the replenishment section 50, a structure of a replenishment section installed in a tandem type full color device is repurposed, a number of toner bottles that can be installed is restricted from four to two, and two sets of hoppers and imaging units are removed from the four sets of the full color device. Accordingly, in the structure of the printer 130, it is easy to increase the number of toner bottles that can be loaded to three or four, and it is easy to increase the number of sets of hoppers and imaging units to three or four. In this case, a single transport screw may pass through an entire container connecting three or more hoppers, or transport screws may each pass through a different pair of hoppers. Further, a range of possible destinations for developer from each toner bottle may include an imaging unit separated by one or more imaging units from the imaging unit directly below the toner bottle, and may be limited to adjacent imaging units.

(E) The conveyance unit 52 of the replenishment section 50 associates the toner bottles 601, 602 and the developer units 531, 532 with each other on a one-to-one basis. This is assuming that the structure of a tandem type full color device is repurposed. Where this assumption is inapplicable or irrelevant, toner bottles and developer units need not be associated with each other on a one-to-one basis. In other words, the structure of the conveyance unit 52 is only required to be able to switch the destination of developer from a given toner bottle between at least two developer units.

Figure 9:
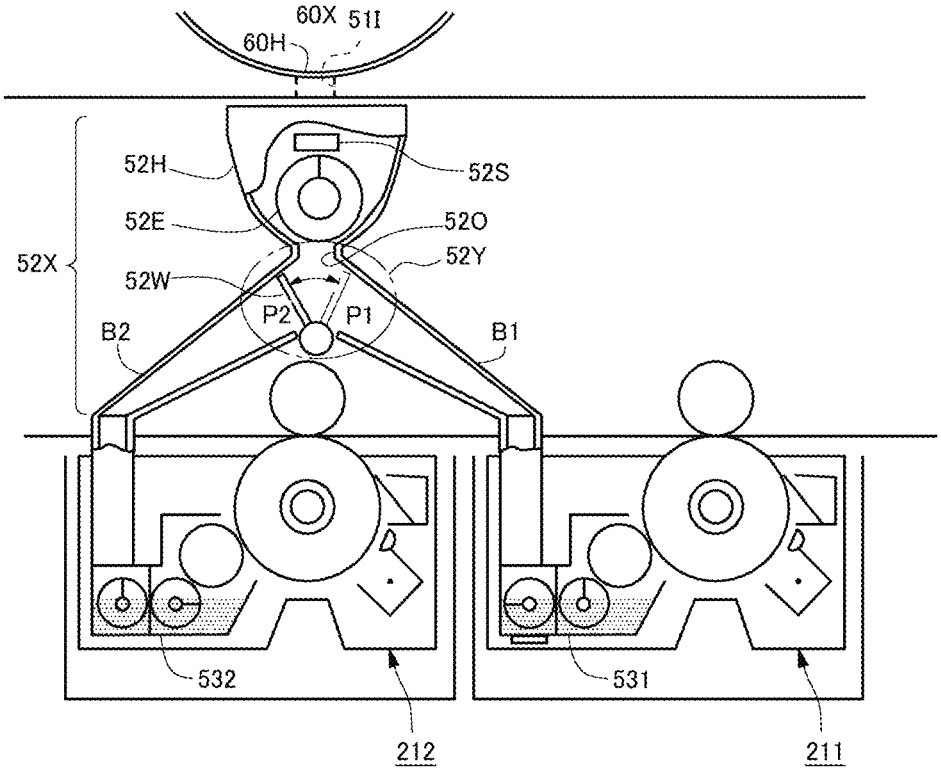
FIG. 9 is a frontal view diagram schematically illustrating an example of a conveyance unit allowing switching of a destination of developer from a toner bottle between two developer units.

FIG. 9 is a frontal view diagram schematically illustrating an example of a conveyance unit 52X provided with such a structure. The conveyance unit 52X includes a storage 52H, the ejection screw 52E, the toner sensor 52S, and a switch 52W. The storage 52H is a single hopper 52H. The hopper 52H is disposed so that developer from a toner bottle 60X installed to the holder 51 flows into the inlet port 52I of the hopper 52H. A forked pipe 52Y is connected to the outlet port 520 at the bottom of the hopper 52H, and two branch pipes B1, B2 extend therefrom in opposite directions from each other and are connected to the replenishing pipes 234 of two different imaging units 211, 212. The ejection screw 52E blocks the outlet port 520 of the hopper 52H. The toner sensor 52S is disposed inside the hopper 52H at a height of an interface between developer and air when a stored amount of developer has been reduced to a permissible lower limit. The switch 52W is a plate-shaped valve body installed in the forked pipe 52Y, and can swing between a first position P1 closing an entrance to the first branch pipe B1 and a second position P2 closing an entrance to the second branch pipe B2. The conveyance unit 52X further includes an actuator such as a motor or solenoid (not illustrated), and a power transmission mechanism such as gears or a belt (not illustrated) to transmit a drive force of the actuator to the switch 52W, whereby the switch 52W is swung between the first position P1 and the second position P2.

Operations to replenish developer by the replenishment section 50 are roughly divided into the following three types. (1) Storing developer in hoppers. (2) Conveyance of developer to imaging section. (3) Switching conveyance destination between developer units.

(1) Storing Developer in Hoppers.

In response to a notification from the main control unit 80 to switch to the running mode, the control system of the replenishment section 50 starts monitoring an amount of developer stored in the hopper 52H. The control system periodically acquires an output signal from the toner sensor 52S at intervals of several hundred milliseconds, for example. While a level of the output signal does not indicate that the hopper 52H is near empty, the control system maintains both the toner bottle 60X and the ejection screw 52E in a stopped state. When the output signal of the toner sensor 52S switches to a level indicating near empty, the control system causes the toner bottle 60X to continuously rotate a certain number of times or for a certain period of time. Accordingly, the control system updates a cumulative value of number of revolutions or rotation time from start of use of the toner bottle 60X. On the other hand, the control system maintains the stopped state of the ejection screw 52E. Thus, an amount of developer corresponding to the certain number of rotations or rotation time of the toner bottle 60X is replenished to the hopper 52H from the toner bottle 60X.

Said replenishment operation is repeated until the output signal level of the toner sensor 52S switches again, but only up to an upper limit of a defined number of times or for a defined time period. If the output signal level of the toner sensor 52S does not switch even after the replenishment operation is repeated an upper limit of times or for an upper limit of time, or the cumulative value of the number of revolutions or revolution time since the start of use of the toner bottle 60X reaches a permissible upper limit, the control system determines that the toner bottle 60X is empty, and notifies the main control unit 80 of same (out of toner). In response to said notification, the main control unit 80 causes the operation panel 71 to display an out-of-toner error, and subsequently stops operation the printer 130.

(2) Conveyance of Developer to Imaging Section.

The control system of the replenishment section 50 receives from the main control unit 80, along with notification to switch to the running mode, designation of the permissible lower limit of toner concentration in developer with respect to a developer unit to be used in printing by the corresponding one of the imaging units 211, 212, such as a first developer unit 531, for example. In response to said notification, the control system first periodically, for example at intervals of several seconds, acquires a measured value of the TCR sensor 245 in the first developer unit 531 from the control system of the imaging section 20, and detects toner concentration in the developer from the measured value. The control system then calculates a developer replenishment amount from a difference between the detected value and the designated permissible lower limit value. If the replenishment amount is greater than or equal to a threshold value, the control system checks the output signal level of the toner sensor 52S. If the output signal level indicates that the hopper 52H is near empty, the control system performs the replenishment operation with respect to the hopper 52H. If the output signal level does not indicate that the hopper 52H is near empty, the control system keeps the switch 52W at the second position P2 to keep an entrance to the second branch pipe B2 closed, and causes the ejection screw 52E to rotate for a number of times or a time period required to supply the replenishment amount of developer to the replenishing pipe 234 of the first developer unit 531 via the first branch pipe B1. Thus, the replenishment amount of developer is conveyed from the hopper 52H to the first developer unit 531 via the first branch pipe B1 and the replenishing pipe 234.

(3) Switching Conveyance Destination Between Developer Units.

For example, when the first developer unit 531 reaches the end of its life or otherwise becomes inoperable, the main control unit 80 notifies the replenishment section 50 of switching from the first imaging unit 211 to the second imaging unit 212. In response to this notification, the control system of the replenishment section 50 causes the switch 52W to swing from the second position P2 to the first position P1, to a state in which the first branch pipe B1 is closed instead of the second branch pipe B2. Thus, the destination to which the ejection screw 52E conveys developer can be switched from the first developer unit 531 to the second developer unit 532. Thus, the printer 130 can continue printing without downtime.

As described above, even in a case other than repurposing of the structure of a tandem type full color machine, as long as structure of the conveyance unit allows a destination of developer from a toner bottle to be switched between two developer units, redundancy is provided, and maintainability and availability is high with respect to developing of the printer 130.

Although embodiments of the present disclosure have been described and illustrated in detail, the disclosed embodiments are made for purposes of illustration and example only and not limitation. The scope of the present disclosure should be interpreted by terms of the appended claims.

What is claimed is:

1. An image forming device that forms an image through exposure of any one of a plurality of photosensitive members to light, image developing, and image transfer, the image forming device comprising:

a holder that holds one or more containers of developer and causes the developer to flow out from a container selected from the one or more containers;

a conveyance unit that conveys the developer from the container to a destination and can switch between at least a first destination and a second destination;

a first developer unit that uses the developer to develop an electrostatic latent image formed on a first photosensitive member among the plurality of photosensitive members; and a second developer unit that uses the developer to develop an electrostatic latent image formed on a second photosensitive member among the plurality of photosensitive members;

a monitoring unit that monitors an operating condition of whichever of the first developer unit and the second developer unit is the destination according to the conveyance unit; and a controller that detects, via the monitoring unit, a malfunction of whichever of the first developer unit and the second developer unit is the destination according to the conveyance unit, and causes the conveyance unit to switch the destination to a developer unit for which a malfunction is not detected, wherein the first destination is the first developer unit and the second destination is the second developer unit, and the image is the same color regardless of which developer unit is used.

2. The image forming device according to claim 1, wherein the conveyance unit includes a storage that temporarily stores the developer that the holder causes to flow out of the container, and the conveyance unit conveys the developer from the storage to either the first developer unit or the second developer unit.

3. The image forming device according to claim 2, wherein the storage is divided into the same number of rooms as a number of containers that the holder can hold and each of the rooms temporarily stores the developer that flows out of a different container, and the conveyance unit includes a path connecting between the rooms of the storage.

4. The image forming device according to claim 2, wherein a pair of the first photosensitive member and the first developer unit and a pair of the second photosensitive member and the second developer unit have the same structure as two pairs of photosensitive member and developer unit of two imaging units for parallel forming of images of different colors in a tandem type image forming device.

5. A control method of an image forming device that forms an electrostatic latent image by exposing any one of a plurality of photosensitive members to light, develops the electrostatic latent image via developer of a first developer unit or a second developer unit to form a developed image, the developed image being the same color regardless of which developer unit is used, and transfers the developed image to a sheet, the control method comprising:

causing developer to flow out of a container among one or more containers installed in the image forming device;

causing the image forming device to convey developer flowing out of the container to a destination selected from the first developer unit and the second developer unit;

causing the image forming device to monitor an operating condition of the whichever of the first developer unit and the second developer unit is the destination; and causing the image forming device to switch the destination to a developer unit for which a malfunction is not detected when the image forming device detects a malfunction in the operating condition of whichever of the first developer unit and the second developer unit is the destination.

6. A computer-readable storage medium storing a computer program executable by a computer of an image forming device that forms an electrostatic latent image by exposing any one of a plurality of photosensitive members to light, develops the electrostatic latent image via developer of a first developer unit or a second developer unit to form a developed image, the developed image being the same color regardless of which developer unit is used, and transfers the developed image to a sheet, the computer program causing the computer of the image forming device to execute:

causing the image forming device to convey developer from a container among one or more containers installed in the image forming device to a destination selected from the first developer unit and the second developer unit;

monitoring an operating condition of the whichever of the first developer unit and the second developer unit is the destination and;

causing the image forming device to switch the destination to a developer unit for which a malfunction is not detected when the image forming device detects a malfunction in the operating condition of whichever of the first developer unit and the second developer unit is the destination.

* * * * *